US005436111A

United States Patent [19]

Fujita et al.

[11] Patent Number: 5,436,111

[45] Date of Patent: * Jul. 25, 1995

[54] COLOR DIFFUSION TRANSFER LIGHT-SENSITIVE MATERIAL

[75] Inventors: Munehisa Fujita; Shigeharu Urabe, both of Kanagawa, Japan

[73] Assignee: Fuji Photo Film Co., Ltd., Kanagawa, Japan

[ * ] Notice: The portion of the term of this patent subsequent to Aug. 24, 2010 has been disclaimed.

[21] Appl. No.: 121,460

[22] Filed: Sep. 16, 1993

Related U.S. Application Data

[63] Continuation of Ser. No. 779,089, Oct. 18, 1991, abandoned.

[30] Foreign Application Priority Data

Oct. 19, 1990 [JP] Japan ..... 2-282513
Mar. 12, 1991 [JP] Japan ..... 3-070399

[51] Int. Cl.[6] ..... G03C 8/10

[52] U.S. Cl. ..... 430/217; 430/223; 430/567; 430/569; 430/570; 430/958

[58] Field of Search ..... 430/217, 223, 958, 567, 430/569, 570

[56] References Cited

U.S. PATENT DOCUMENTS

| | | | |
|---|---|---|---|
| H1285 | 2/1994 | Toya | 430/567 |
| 4,414,306 | 11/1983 | Wey et al. | 430/596 |
| 4,434,226 | 2/1984 | Wilgus et al. | 430/567 |
| 4,478,929 | 10/1988 | Jones et al. | 430/217 |
| 4,783,396 | 11/1988 | Nakamura et al. | 430/958 |
| 4,806,461 | 2/1989 | Ikeda et al. | 430/569 |
| 4,814,264 | 3/1989 | Kishida et al. | 430/567 |
| 4,839,268 | 6/1989 | Bando | 430/567 |
| 4,879,208 | 11/1989 | Urabe | 430/567 |
| 4,891,304 | 1/1990 | Nakamura | 430/223 |
| 4,977,075 | 12/1990 | Ihama et al. | 430/567 |
| 5,017,454 | 5/1991 | Nakamine et al. | 430/223 |
| 5,021,334 | 6/1991 | Koya | 430/223 |
| 5,028,521 | 7/1991 | Grzeskowiak | 430/567 |
| 5,049,474 | 9/1991 | Ichijima et al. | 430/958 |
| 5,068,173 | 11/1991 | Takehara et al. | 430/567 |
| 5,139,919 | 8/1992 | Taguchi et al. | 430/223 |
| 5,238,796 | 8/1993 | Maruyama et al. | 430/567 |

FOREIGN PATENT DOCUMENTS

| | | | |
|---|---|---|---|
| 2906526 | 8/1979 | Germany | 430/223 |
| 63-271443 | 11/1988 | Japan | 430/958 |

OTHER PUBLICATIONS

James, T. H., "Theory of the photographic process" p. 20 ©1977.

*Primary Examiner*—Charles L. Bowers, Jr.
*Assistant Examiner*—M. J. Angebranndt
*Attorney, Agent, or Firm*—Sughrue, Mion, Zinn, Macpeak & Seas

[57] ABSTRACT

A color diffusion transfer light-sensitive material is described including a support having thereon at least one light-sensitive emulsion layer associated with a dye image-forming material and an electron donor, wherein the dye image-forming material comprises at least one reducible dye-providing compound represented by formula (I) which releases a diffusible dye upon being reduced and tabular silver halide grains having a mean grain diameter of at least about 0.3 μm, a mean grain thickness of less than about 0.5 μm, and a mean aspect ratio of at least about 2 account for at least about 50% of the total projected area of the silver halide grains contained in at least one light-sensitive emulsion layer;

$$\text{PWR - (Time)}_t\text{ - Dye} \qquad \text{(I)}$$

wherein PWR represents a group capable of releasing -(Time)$_t$-Dye upon being reduced; Time represents a group capable of releasing Dye through a subsequent reaction after being released as -(Time)$_t$-Dye from PWR; t represents 0 or 1; and Dye represents a dye or a dye precursor.

19 Claims, No Drawings

COLOR DIFFUSION TRANSFER LIGHT-SENSITIVE MATERIAL

This is a Continuation of Application No. 07/779,089, filed Oct. 18, 1991, now abandoned.

FIELD OF THE INVENTION

The present invention relates to a color diffusion transfer light-sensitive material, and more particularly to a color diffusion transfer light-sensitive material which can form a positive image by combining a non-diffusible compound releasing a diffusible dye in countercorrespondence to the reaction in which a silver halide is reduced to silver (hereinafter, the foregoing compound is referred to as a positive dye-providing compound) and an ordinary negative working silver halide emulsion.

More specifically, the present invention relates to a color diffusion transfer light-sensitive material having a high sensitivity and forming the foregoing positive image having a low minimum density.

BACKGROUND OF THE INVENTION

As processes of directly forming positive images by a color diffusion transfer process, there are A) a process of using a combination of a direct positive silver halide emulsion and a non-diffusible compound which can release a diffusible dye corresponding to the reaction in which a silver halide is reduced to silver (hereinafter, this compound is referred to as a negative type dye-providing compound) and B) a process of using a combination of an ordinary silver halide emulsion (a negative-positive responding silver halide emulsion) and a non-diffusible compound which becomes diffusible in countercorrespondence to the reaction in which a silver halide is reduced to silver or a non-diffusible compound which can release a diffusible dye in countercorrespondence to the reaction in which a silver halide is reduced to silver (these compounds are referred to as positive dye-providing compound).

In process A), the compound which is a coupler having a non-diffusible dye as a releasable group and which releases the diffusible dye by a coupling reaction with the oxidation product of a reducing agent (DDR coupler) described, e.g., British Patent 1,330,524, JP-B-48-30165 (the term "JP-B" as used herein means an "examined published Japanese patent publication"), and U.S. Pat. Nos. 3,443,940, 4,474,867 and 4,483,914, and a compound which reduces a silver halide and which releases a diffusible dye by reducing a silver halide (DRR compound) described in U.S. Pat. Nos. 3,928,312, 4,063,312, 4,055,428, and 4,336,322 are used.

In process B), (1) a hydroquinone series developer and a dye developing agent bonded to a dye moiety (the dye developer is diffusible under an alkaline condition but becomes non-diffusible upon reacting with a silver halide) described in U.S. Pat. Nos. 3,134,764, 3,362,819, 3,597,200, 3,544,545, 3,482,972, etc., (2) a non-diffusible compound which releases a diffusible dye under an alkaline condition but loses this ability when it reacts with a silver halide described in U.S. Patent 4,503,137, etc., a compound capable of releasing a diffusible dye by an intramolecular nucleophilic substitution reaction described in U.S. Pat. No. 3,980,479, etc., or a compound capable of releasing a diffusible dye by an intramolecular rearrangement reaction of an isooxazolone ring described in U.S. Pat. No. 4,199,354, etc., or (3) a non-diffusible compound copable of releasing a diffusible dye by reacting a reducing agent remained without being oxidized by the development described in U.S. Pat. Nos. 4,559,290 and 4,783,396, European Patent 220,746A2, and Kokai Giho 87-6199, etc., is used.

In the foregoing two processes, process B) is preferred for easily obtaining a high sensitivity. However, with process B), it is difficult to reduce the minimum density portion, which is particularly important in an image formation process.

In process B), the density of the minimum density portion (corresponding to a high exposure portion) of a positive image is determined by the competing reactions of the dye-releasing reaction by a reducible dye-providing compound and an electron donor and an oxidation reaction of an electron donor by the oxidation product of an electron transferring agent (formed by the development of a photosensitive silver halide).

Accordingly, for lowering the minimum density while keeping the high density, a technique of making the formation of the oxidation product of the electron transferring agent an optimum state by controlling the development of the photosensitive silver halide is needed.

As silver halide grains which are used for silver halide photographic materials, various grain forms are known, and as one kind thereof, tabular silver halide grains are known.

In regard to tabular silver halide grains, production methods and techniques for using these grains are disclosed in U.S. Pat. Nos. 4,434,226, 4,439,520, 4,414,310, 4,433,048, 4,414,306, and 4,459,353 and JP-A-59-99433 and JP-A-62-209445 (the term "JP-A" as used herein means an "unexamined published Japanese patent application"), and the advantages provided by the tabular silver halide grains, such as the improvement of sensitivity, including the improvement of color sensitizing efficiency by a sensitizing dye, the improvement of the relation of sensitivity and graininess, the improvement of sharpness by the specific optical property of the tabular silver halide grains, the improvement of covering power, etc., are known.

A heat developable light-sensitive material using tabular silver halide grains composed of (100) crystal planes is disclosed in JP-A-1-161335, but the invention thereof relates to an image-forming process using a developing process which is significantly different from the developing process in the present invention. Also, the effects thereof are significantly different from those of the present invention.

The dislocation of silver halide crystals is described in C. R. Berry, *Journal of Applied Physics,* 27, 636 (1956), C. R. Berry and D. C. Skilman, *Journal of Applied Physics,* 35, 2165 (1964), J. F. Hamilton, *Phot. Sci. Eng.,* 11, 57 (1967), T. Shiozawa, *J. Soc. Phot. Sci. Jap.,* 34, 16 (1971), T. Shiozawa, *J. Soc. Phot. Sci. Jap.,* 35, 213 (1972), etc. It is stated therein that the dislocation in a crystal can be observed by an X-ray diffraction method or a low-temperature transmission type electron microscopic method, and various dislocations occur in a crystal as a result of a strain to the crystal.

The influences of the dislocation on the photographic performance are described in G. C. Famell, R. B. Flint & J. B. Chaneter, *J. Phot. Sci.,* 13, 25 (1969), and it is shown therein that in tabular silver bromide grains having a large grain size and a high aspect ratio, the site of the formation of a latent image nucleus has a close relation with a defect in the crystal.

JP-A-63-220238 and JP-A-1-201649 disclose tabular silver halide grains having dislocations introduced therein. It is shown therein that the tabular silver halide grains having dislocations introduced therein are excellent in photographic characteristics such as sensitivity, reciprocity law, etc., as compared to tabular silver halide grains having no dislocation. Also, a photographic light-sensitive material using tabular silver halide grains having dislocations is excellent in sharpness and graininess. However, in these tabular silver halide grains, the dislocation lines are irregularly introduced into the edges of the tabular grains, and the number of dislocations differs in each grain.

A silver halide photographic emulsion comprising a dispersant and tabular silver halide grains having dislocations in the major surface region is disclosed in U.S. Ser. No. 710,346.

SUMMARY OF THE INVENTION

An object of the present invention is, therefore, to overcome the foregoing problems and to provide a color diffusion transfer light-sensitive material having a high sensitivity and forming a positive image having a low minimum density and a good color reproducibility.

It has now been discovered that the aforesaid object and other objects described hereinafter can be attained by the present invention as described hereinbelow.

That is, the present invention provides a color diffusion transfer light-sensitive material comprising a support having thereon at least one light-sensitive silver halide emulsion layer associated with a dye image-forming material and an electron donor, wherein the dye image-forming material comprises at least one reducible dye-providing compound represented by formula (I) which releases a diffusible dye upon being reduced and tabular silver halide grains having a mean grain diameter of at least about 0.3 μm, a mean grain thickness of less than about 0.5 μm, and a mean aspect ratio (mean grain diameter/mean grain thickness) of at least about 2 account for at least about 50% of the total projected area of the silver halide grains contained in at least one layer of the at least one light-sensitive emulsion layer;

$$\text{PWR - (Time)}_t\text{- Dye} \qquad \text{(I)}$$

wherein PWR represents a group capable of releasing -(Time)$_t$-Dye upon being reduced; Time represents a group capable of releasing Dye through a subsequent reaction after being released as -(Time)$_t$-Dye from PWR; t represents 0 or 1; and Dye represents a dye or a dye precursor.

DETAILED DESCRIPTION OF THE INVENTION

The invention is described in detail below.

With respect to the grain characteristics described above of the silver halide, such as an aspect ratio, a projected area of the silver halide grains, a diameter of the grains, reference can be made to *Research Disclosure* No. 22534 (January, 1983), line 60 at right column on page 21 to line 1 at left column on page 22.

One of the features of this invention is in the use of a silver halide emulsion containing the silver halide grains defined above, that is, tabular silver halide grains (hereinafter referred to as tabular grains).

Tabular grains are grains having two parallel or nearly parallel main planes facing each other, the circle-corresponding diameter of the main plane (the diameter of the circle having the same area as the projected area of the main plane) being at least twice the distance between the main planes (i.e., the thickness of the grain).

The ratio of the mean grain diameter to the mean grain thickness (hereinafter referred to as the aspect ratio) of the tabular grains contained in the silver halide emulsion for use in the present invention is at least about 2, preferably from 3 to 12, and particularly preferably from 5 to 10.

In this case, the aspect ratio of the grains can be obtained by averaging the diameter/thickness ratios of all of the tabular grains, but as a simple method, it can also be considered as the ratio of the mean diameter of all of the tabular grains to the mean thickness of all of the tabular grains.

The diameters (circle-corresponding) of the tabular grains for use in this invention are at least about 0.3 μm, preferably from 0.3 μm to 10 μm, more preferably from 0.5 μm to 5.0 μm, and particularly preferably from 0.5 μm to 2.0 μm.

The thickness of the tabular grains for use in this invention is less than about 0.5 μm, preferably from 0.05 μm to 0.4 μm, and more preferably from 0.08 μm to 0.3 μm.

The foregoing tabular grains contained in the silver halide emulsion for use in this invention account for at least about 50%, preferably at least 70%, and more preferably at least 90% of the total projected area of all of the silver halide grains.

In a preferred embodiment of the present invention, at least about 50% of the total projected area of the silver halide grains contained in at least one layer of the at least one light-sensitive emulsion layer are silver halide grains having a mean grain diameter of at least about 0.3 μm, a mean grain thickness of less than about 0.5 μm, and a mean aspect ratio of at least 5.

In this invention, the diameters and thicknesses of the grains can be measured by electron microphotographs of the grains, as in the method described in U.S. Pat. No. 4,434,226.

As the halogen composition of the tabular grains, silver chloroiodide, silver iodobromide, silver chloride, silver chlorobromide, silver bromide, or silver chloroiodobromide can be used in practice, although silver bromide or silver chlorobromide is preferably used in this invention.

Tabular grains for use in this invention can be produced by an appropriate combination of the methods described in U.S. Pat. Nos. 3,343,226, 4,439,520, 4,414,310, 4,399,215, 4,433,048, 4,386,156, 4,400,463, 4,414,306, and 4,435,501.

For example, tabular grains can be obtained by forming seed crystals containing at least about 40% by weight tabular grains in an atmosphere of a relatively high pAg of, for example, pBr of not higher than about 1.3, and growing the seed crystals by adding thereto a silver salt solution and a halide solution while keeping the pBr value at the same value or higher than the foregoing value.

In this case, it is desirable that in the course of growing the grains by the addition of a silver salt and a halide, the solution of the silver salt and the solution of the halide are added such that new seed crystal nuclei do not form.

The size of the tabular grains can be controlled by controlling the temperature, selecting the kind and the amount of the solvent, and controlling the addition rate of the silver salt and halide being used during the growth of the grains.

In this invention, the following monodisperse hexagonal tabular silver halide grains can be used.

The silver halide emulsion containing monodisperse hexagonal tabular grains is a silver halide emulsion composed of a dispersion medium and the silver halide grains, such that tabular silver halide grains having a hexagonal form wherein the ratio of the length of the side having the longest length to the length of the side having the shortest length is not more than about 2 and having two parallel planes as the outer surfaces account for at least about 70% of the total projected area of all of the silver halide grains, the hexagonal tabular silver halide grains have a monodispersibility such that the coefficient of variation (the value of the dispersion (standard deviation) of grain sizes as determined by the circle-corresponding diameters of the projected areas divided by the mean grain size) of the grain size distribution of the hexagonal tabular grains is not more than about 20%, the aspect ratio thereof is at least about 2.5, and the mean grain size is at least about 0.2 μm.

The halogen composition of the hexagonal tabular grains may be silver bromide, silver iodobromide, silver chlorobromide, or silver chloroiodobromide. When the tabular grains contain an iodide ion, the content thereof is from just above 0 mol % to about 30 mol %. The crystal structure may be uniform throughout the grain, it may be composed of a different halogen composition between the inside and the surface portion of the grain, or it may have a layer structure. Also, it is preferable that the hexagonal tabular grains contain therein reduction sensitizing silver nuclei.

The foregoing hexagonal tabular silver halide grains can be produced through the formation of nuclei, Ostwald ripening, and grain growth, and the details thereof are described in JP-A-63-151618.

Furthermore, it is preferable that the tabular silver halide grains have dislocations. That is, it is preferable that the main parallel planes facing each other are composed of (111) crystal planes and, further, that at least about 30% of the tabular grains have dislocations in the main planes.

The dislocations of the tabular grains can be observed by a direct method using a low-temperature transmission type electron microscope described in, e.g., J. F. Hamilton, *Phot. Sci. Eng.*, .31, 57 (1967) and T. Shiozawa, *J. Soc. Phot. Sci. Japan*, 35, 213 (1972), as described above. That is, silver halide grains removed from a silver halide emulsion under safelight with the care, such that pressure of an extent to cause dislocations in the grains is not applied, are placed on a mesh for electron microscopic observation, and the grains are observed by transmitted light during a state of cooling the sample for preventing the occurrence of damage (printout, etc.) by electron beams. In this case, as the thickness of the grains is greater, an electron beam is less likely to transmit, and thus in the case of such thick grains, the dislocations can be more clearly observed by using a high voltage type electron microscope (higher than 200 kV for grains having a thickness of about 0.25 μm or more). From the photographs obtained with this method, the positions of the dislocations can be obtained on each grain in the case where observation was in the direction perpendicular to the main plane.

The dislocations existing in the silver halide grains for use in the present invention exist in the main surface regions of the tabular grains.

The main surface region of the tabular grains is a region having certain thickness including outer surfaces composed of parallel (111) planes facing each other.

That is, the tabular grains for use in this invention are tabular grains having dislocations in the main surface region, excluding the edge portions of the main surfaces. The edge portion is a region having an area corresponding to a circular region extending about 5% from the circumference of the circle having the same area as the main surface to the center in the radius direction, existing at the circumference of the tabular grain, and having the thickness of the tabular grain. The center region of the tabular grain is a region having a radius of about 10% of the radius of the circle having the same area as the main surface of the grain and having the thickness of the tabular grain at the circle portion having a common center. The dislocations in this invention do not localize at specific positions of the main surface regions of a host particle, such as the foregoing edge portion and center portion.

A key feature of tabular grains is that the area of the main surface is large as compared to the volume of the grain, and by introducing dislocations in the large main surface region thereof, the tabular grains can be most effectively utilized. The ratio of the area of the main surface having the dislocations in the present invention to the whole main surface area is from about 10% to about 100%, preferably from 20% to 100%, and more preferably from 30% to 100%.

The production process for the tabular grains in the present invention is explained below.

That is, the tabular grains for use in the present invention are prepared by the following four steps:

(1) preparation of tabular grains which become the bases (hereinafter referred to as "base grains" or "host grains"), (2) formation of many fine epitaxies of silver chloride or silver chlorobromide on the main surfaces of the base tabular grains, (3) physical ripening of the many fine epitaxies on the main surfaces of the base tabular grains and/or a conversion by a halogen, and (4) growth of dislocations by the formation of silver halide shells.

Since the dislocations form at the place having attached thereto fine epitaxies of silver chloride or silver chlorobromide, the place having dislocations is determined by controlling the location of the fine epitaxies. The halogen composition of the base particles may be silver bromide, silver iodobromide, silver chlorobromide or silver chloroiodobromide, although silver bromide is preferred.

In regard to the tabular silver halide grains as base particles, the production process and the technique for using these grains are disclosed in U.S. Pat. Nos. 4,434,226, 4,439,520, 4,414,310, 4,433,048, 4,414,306, 4,459,353, etc.

Also, in the formation of base grains, it is desirable that the tabular particles are formed by adding fine silver halide grains to a reaction vessel containing an aqueous protective colloid solution, rather than adding thereto an aqueous silver salt solution and an aqueous halide solution. With the foregoing desirable method, the increase in the thickness of the tabular grains during the growth of the grains is significantly decreased. The technique of the process is disclosed in U.S. Pat. No. 4,879,208 and JP-A-1-183644, JP-A-2-44335, JP-A-2-43535, and JP-A-2-68538.

Furthermore, the base grains in this invention are preferably a monodisperse. The structure and the production process of the monodisperse tabular grains are described, e.g., in JP-A-63-151616, and the form is explained briefly. That is, the tabular grains are monodisperse tabular grains wherein tabular silver halide grains having a hexagonal form in which the ratio of the length of the longest side to the length of the shortest side is not more than about 2 and having two parallel outer surfaces account for at least about 70% of the total projected area of all of the silver halide grains, and the coefficient of variation of the grain size distribution of the hexagonal tabular silver halide grains is not higher than about 20%.

Using the above-described tabular grains as host grains, silver chloride or silver chlorobromide is deposited and attached to the main surfaces of the host grains as many fine epitaxies. Practically, an aqueous silver salt solution and an aqueous solution of halide (silver chloride or a mixture of silver chloride and silver bromide) are added to a reaction vessel containing the host grains at a silver potential (using a saturated calomel electrode as a reference electrode) of from +30 mV to +300 mV, and preferably from +50 mV to +250 mV. The temperature of the reaction vessel is from about 30° C. to about 70° C., preferably from 35° C. to 60° C., and more preferably from 35° C. to 50° C. The amounts of the silver salt (mainly silver nitrate) and the halide(s) being added are from 0.1 to 30 mol %, preferably from 0.5 to 20 mol %, and more preferably from 1 to 10 mol %. The size and the number of the epitaxies formed depend upon the formation condition of the epitaxy and the halogen composition of the host grains. The size of the epitaxies can be confirmed by an electron microscopic photograph in a replica method, the mean diameter based on the projected area of the epitaxies is not larger than 0.15 μm, and from about 10 to about 10,000 epitaxies/$m^2$ are present on the main surface of the host grain.

Then, physical ripening and/or a conversion by halogen of the epitaxies on the main surfaces of the host grains is carried out. When physical ripening is carried out, the fine epitaxies collapse to form large hill-forms, and it is considered that in this case, dislocation lines are introduced.

The temperature for physical ripening is from about 40° C. to about 90° C., preferably from 50° C. to 90° C., and more preferably from 60° C. to 80° C.

The halogen conversion is a step of displacing the halogen forming silver halide crystals with a different halogen. The conversion is caused by adding a halogen forming a silver halide having a lower solubility product than the silver halide existing as the crystals, and the conversion is started from a portion having a higher solubility of silver halide. Accordingly, for carrying out the halogen conversion, any halogen of a composition giving a silver halide having a lower solubility than the epitaxially grown silver halide can be optionally used.

The addition amount of the halogen is preferably from about 5 to about 100 mol %, and more preferably from 10 to 50 mol % of the amount of epitaxially grown silver.

The halogen being used is added as as aqueous solution of an iodide, a mixture of an iodide and a bromide, or a bromide. Also, it is preferable that the halogen is added as fine grains of silver iodide, silver iodobromide, or silver bromide. The size of the fine grains is not larger than about 0.1 μm, and preferably not larger than 0.06 μm. These fine grains can be previously prepared as a fine grain silver halide emulsion, but it is preferred to supply these fine silver halide grains from a mixer according to the method disclosed in U.S. Pat. No. 4,879,208.

The growth of dislocations by the formation of shells is explained as follows. Dislocations are introduced by physical ripening and/or the halogen conversion of the fine epitaxies formed on the main surfaces of the host tabular grains, and thereafter, when shells are formed by further adding thereto an aqueous silver salt solution and an aqueous halide solution, the dislocations are grown with the formation of the shells. The amount of silver in the shell may be at least about 5% of the amount of silver in the host grains. The halogen composition of the shells is optional and may be silver chloride, silver bromide, silver iodobromide, silver chloroiodobromide, or silver chlorobromide.

As a method for forming shells, the foregoing production process for the base tabular grains can be used. That is, the production process and the technique of using the shells are as disclosed in U.S. Pat. Nos. 4,434,226, 4,439,520, 4,414,310, 4,433,048, 4,414,306, and 4,459,353.

Also, in the formation of shells, the formation of the tabular grains can be carried out by adding fine silver halide grains to a reaction vessel containing an aqueous protective colloid solution, rather than adding an aqueous silver salt solution and an aqueous halide solution. Techniques for this method are disclosed in U.S. Pat. No. 4,879,208 and JP-A-l-183644, JP-A-2-44335, JP-A-2-43535, and JP-A-2-68538.

Thus, according to the present invention, dislocations can be introduced to selected regions on the main surfaces of the tabular silver halide grains or to the whole main surfaces of the tabular grains. As to the distribution of the dislocations introduced in this invention in the depth direction, as is clear from the production process described hereinbefore, the starting point of the dislocations is the main surface of the host tabular grain, and thereafter the dislocations reach the surface of the shell by the formation of the shell. Accordingly, the dislocations exist between the main surface of the host grain and the surface of the shell, and thus the dislocations in this invention are significantly different from the dislocations disclosed in JP-A-63-220238 and JP-A-1-201649. That is, the dislocations disclosed in the above two inventions are introduced into the vicinity of the edges of tabular grains and thus are significantly different from the dislocations in the present invention with respect to the dislocation itself and the distribution thereof.

The dislocations in the present invention can be easily confirmed by observing the transmitted images of the tabular silver halide grains using a transmission type electron microscope. For example, the dislocations can be observed by the direct method using a low-temperature transmission type electron micrograph described in J. F. Hamilton, *Phot. Sci. Eng.*, 11, 57 (1967) and T. Shiozawa, *J. Soc. Phot. Sci. Japan*, 35, 213 (1972), as described above.

That is, silver halide grains removed from a silver halide emulsion under a safelight in such a manner that the silver halide grains do not cause printout are placed on a mesh for electron microscopic observation and are observed by a transmission method in a state of cooling the sample with liquid nitrogen or liquid helium for preventing the occurrence of damage (printout, etc.) by electron beams.

In this case, as the acceleration voltage of the electron microscope increases, a clearer transmitted image is obtained, but it is preferred that the acceleration voltage is 200 kV up to 0.25 μm of grain thickness and is 1,000 kV for the grains having a thickness greater than the aforesaid value. Since, as the acceleration voltage increases, the damage to the grains by electron beams becomes larger, it is desirable to cool the sample with liquid nitrogen or liquid helium.

The photographing magnification can be properly changed according to the size of the sample grains but is generally from 200,000 to 400,000 times.

The size of the tabular grains can be controlled by the control of the temperature, the selection of the kind and amount of the solvent, and the control of the addition rates of a silver salt and halide being used during the growth of the grains.

Chemical sensitization is applied to the grain surfaces of the tabular grains contained in the silver halide emulsion for use in the present invention.

The foregoing chemical sensitization can be carried out using active gelatin as described in T. H. James, *The Theory of the Photographic Process,* 4th ed., pages 67–76 (published by Macmillan, 1977) or can be carried out using sulfur, selenium, tellurium, gold, platinum, palladium, iridium, rhodium, or a combination of these sensitizers at a pAg of from about 5 to about 10, a pH of from about 5 to about 8, and a temperature of from 30° C. to 80° C. as described in *Research Disclosure*, Vol. 120, No. 12008 (April, 1974), ibid., Vol. 34, No. 13452 (June, 1975), U.S. Pat. Nos. 2,642,361, 3,287,446, 3,772,031, 3,857,711, 3,901,714, 4,266,018 and 3,904,415, and British Patent 1,315,755. The chemical sensitization is most suitably carried out in the presence of the sulfur-containing compounds described in U.S. Pat. Nos. 3,857,711, 4,266,018, and 4,054,457 or a sulfur-containing compound such as hypo, a thiourea series compound, a rhodanine series compound, etc., in the presence of a gold compound and a thiocyanate compound.

The silver halide emulsion can be chemically sensitized in the presence of a chemical sensitization aid. As the chemical sensitization aid, compounds which are known to restrain the formation of fog and increase the sensitivity in the step of chemical sensitization, such as azaindene, azapyridazine, and azapyrimidine, can be used. Examples of the chemical sensitization aid are described in U.S. Pat. Nos. 2,131,038, 3,411,914, and 3,554,757, JP-A-58-126536, and Duffin, *Photographic Emulsion Chemistry*, pages 138–143, published by Focal Press, 1966.

In addition to or in place of chemical sensitization, reduction sensitization with, for example, hydrogen, as described in U.S. Pat. Nos. 3,891,446 and 3,984,249, can be used, or reduction sensitization can be applied by using a reducing agent such as stannous chloride, thiourea dioxide, and polyamine as described in U.S. Pat. Nos. 2,518,698, 2,743,182 and 2,743,183, by using a low pAg (e.g., lower than about 5) treatment, or by using a high pH (e.g., higher than about 8) treatment. Also, the chemical sensitizing method described in U.S. Pat. Nos. 3,917,485 and 3,966,476 can be applied.

Also, the sensitizing method using the oxidizing agent described in JP-A-61-3134 and JP-A-61-3136 can be applied.

In the production of the silver halide emulsion containing the tabular grains for use in this invention, a method of increasing the addition rates, addition amounts, and addition concentrations of an aqueous silver salt solution (e.g., an aqueous silver nitrate solution) and an aqueous halide solution (e.g., an aqueous potassium bromide solution) which are added for accelerating the growth of the tabular grains can be preferably used.

These methods are described, e.g., in British Patent 1,335,925, U.S. Pat. Nos. 3,672,900, 3,650,757, and 4,242,445, and JP-A-55-142329 and JP-A-55-158124.

For accelerating the foregoing ripening, a silver halide solvent is useful. For example, it is known for accelerating ripening that an excessive amount of a halide ion should be present in the reaction vessel. Therefore, by only introducing an aqueous halide solution into the reaction vessel, ripening can be accelerated. Also, other ripening agents can be used, the total amount of the ripening agent can be added to the dispersion medium in the reaction vessel before adding thereto an aqueous silver salt solution and an aqueous halide solution, or the ripening agent can be introduced into the reaction vessel together with the addition of an aqueous halide solution, an aqueous silver salt solution or a deflocculating agent. In another modified embodiment, the ripening agent can be introduced into the reaction vessel independently during the step of adding an aqueous halide solution and an aqueous silver salt solution.

As ripening agents other than halide ions, ammonia, an amine compound, or a thiocyanate salt such as an alkali metal thiocyanate, in particular sodium or potassium thiocyanate and ammonium thiocyanate, can be used. The use of a thiocyanate ripening agent is disclosed in U.S. Pat. Nos. 2,222,264, 2,448,534, and 3,320,069. Also, thioether ripening agents, which are ordinary used as described in U.S. Pat. Nos. 3,271,157, 3,574,628, and 3,737,313, can be used. Furthermore, the thione compounds described in JP-A-53-82408 and JP-A-53-44319 can be used.

The properties of silver halide grains can be controlled by incorporating various compounds in the system during the formation of silver halide precipitates. Such compounds may previously exist in the reaction vessel or may be added to the reaction vessel with the addition of one or more salts according to an ordinary method.

Also, as described in U.S. Pat. Nos. 2,448,060, 2,628,167, 3,737,313, and 3,772,031 and *Research Disclosure*, Vol. 134, No. 13452 (June, 1975), the characteristics of silver halide grains can be controlled by having a compound of copper, iridium, lead, bismuth, cadmium, or zinc, a chalcogen compound such as sulfur, selenium, tellurium, etc., gold, or a noble metal belonging to group VII of the periodic table present in the system during the formation of the silver halide precipitates. In a silver halide emulsion, the inside of the silver halide grains can be reduction sensitized during the step of forming the silver halide precipitates as described in JP-B-58-1410 and Noisar et al., *Journal of Photographic Science*, Vol. 25, 19–27 (1977).

In the tabular grains for use in this invention, a silver halide having a different composition may be junctioned thereto by an epitaxial junction. Also, the tabular grains may be junctioned to a compound other than silver halide, such as silver rhodanide, an oxide, etc. The silver halide emulsions containing such tabular grains are disclosed in U.S. Pat. Nos. 4,094,684, 4,142,900, 4,459,353, British Patent 2,038,792, U.S. Pat. Nos. 4,349,622, 4,395,478, 4,433,501, 4,463,087, 3,656,962, and 3,852,067, and JP-A-59-162540.

The silver halide emulsion containing the tabular grains for use in this invention can be used in the same silver halide emulsion layer with ordinary silver halide grains (hereinafter referred to as "non-tabular grains"), and in particular, in the case of a color photographic light-sensitive material, a silver halide emulsion containing the tabular grains and a silver halide emulsion containing nontabular grains can be used for different emulsion layers and/or the same emulsion layer.

As the nontabular grains, regular silver halide grains having a regular crystal form such as cubic, octahedral, tetradecahedral, etc., and silver halide grains having an irregular crystal form such as spherical, potato-like, etc. can be used. Also, as the silver halide composition of these nontabular grains, silver bromide, silver iodobromide, silver iodochloro-bromide, silver chlorobromide, and silver chloride can be used, although silver bromide or silver chlorobromide is preferably used.

The nontabular grains being used may be fine grains having grain sizes of not more than about 0.1 μm or large grains of up to about 10 μm as the projected area diameters. Also, the silver halide emulsion containing the nontabular grains may be a monodisperse emulsion having a narrow grain size distribution or a polydisperse emulsion having a broad grain size distribution.

The nontabular grains for use in this invention can be prepared using the methods described in P. Glafkides, *Chimie et Physique Photographique*, published by Paul Montel, 1967, G. F. Duffin, *Photographic Emulsion Chemistry*, published by Focal Press, 1966, V. L. Zelikman et al, *Making and Coating Photographic Emulsion*, published by Focal Press, 1964, etc.

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the presence of excess silver ions can also be used. As one system of the double jet method, a so-called controlled double jet method of keeping a constant pAg in a liquid phase of forming silver halide grains can also be used. According to this method, a silver halide emulsion containing silver halide grains having a regular crystal form and substantially uniform grain sizes can be obtained. Two or more kinds of silver halide emulsions separately formed may be used as a mixture thereof.

The foregoing silver halide emulsion containing regular silver halide grains can be obtained by controlling pAg and pH during the formation of the silver halide grains. The details are described in *Photographic Science and Engineering*, Vol. 6, 159–165 (1962), *Journal of Photographic Science*, Vol. 12, 242–251 (1964), U.S. Pat. No. 3,655,394, and British Patent 1,413,748.

Also, the monodisperse silver halide emulsions are described in JP-A-48-8600, JP-A-51-39027, JP-A-51-83097, JP-A-53-137133, JP-A-54-48521, JP-A-54-99419, JP-A-58-37635, JP-A-58-49938, JP-B-11386, U.S. Pat. No. 3,655,394 and British Patent 1,413,748.

The crystal structure of these nontabular grains may be uniform throughout the grain, may be different in halogen composition between the inside and the surface portion thereof, or may have a layer structure. These silver halide grains are disclosed in British Patent 1,027,146, U.S. Pat. Nos. 3,505,068 and 4,444,877, and JP-A-58-248469.

The monodisperse silver halide emulsion (non-tabular grains) is defined such that at least about 95% of the total weight or total number of the silver halide grains contained therein are within ±40%, and more preferably within ±30% of the mean grain size thereof.

The tabular grains and nontabular grains for use in this invention are usually physically ripened, chemically ripened, and spectrally sensitized at use. The additives which are used in these steps are described in *Research Disclosure*, No. 18643 and ibid., No. 18716.

In the present invention, by carrying out the chemical sensitization in the presence of sensitizing dye(s), a particularly preferred effect is obtained. As the sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes, etc. can be used.

Examples of the suitable sensitizing dyes which can be used in this invention are described in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525, and Belgian Patent 691,807.

The addition amount of the foregoing sensitizing dye is at least about 0.1 millimol, preferably from 0.1 millimol to 4 millimols, and particularly preferably from 0.2 millimol to 1.5 millimols.

Each element included in the present invention is explained below.

(A) Support

As the support used in the present invention, transparent supports, white supports, black supports, etc. can be used, usually as flat photographic supports.

As a transparent support, a polyethylene terephthalate film, a cellulose acetate film, a polycarbonate film, etc., having a thickness of from about 50 μm to about 350 μm, and preferably from 70 μm to 210 μm, is used. The transparent support may contain a slight amount of a pigment such as titanium dioxide, etc., or a dye for preventing light piping.

The white support for use in this invention is a support having white color on at least the side having a dye-receiving layer, and any support having a sufficient whiteness and flatness can be used. For example, a polymer film such as a film of polyethylene terephthalate, polystyrene, polypropylene, etc., formed by ordinary successive biaxially stretching, whitened by adding a white pigment such as titanium oxide, barium sulfate, lead oxide, etc., having grain sizes of from 0.1 to 5 μm; a synthetic paper; or a paper laminated on both the surfaces thereof with polyethylene, polyethylene terephthalate, polypropylene, etc., is preferably used. The laminated layer may have kneaded therein a white pigment such as titanium white.

The thickness of the support is from about 50 μm to about 350 μm, preferably from 70 μm to 210 μm, and particularly preferably from 80 μm to 150 μm.

Also, if necessary, a light shading layer may be formed on the support. For example, a support having a polyethylene laminate containing a light shading agent such as carbon black, etc., at the back surface of the white support can be used.

As the black support, a polyethylene terephthalate film, a cellulose acetate film, a polycarbonate film, a polystyrene film, a polypropylene film, etc., having a thickness of from about 50 μm to about 350 μm, preferably from 70 μm to 210 μm, each containing a light shading agent such as carbon black, and a paper support having a thickness of from 50 μm to 400 μm, preferably from 70 μm to 250 μm, containing a light shading agent such as carbon black, each being coated with polyethylene, polyethylene terephthalate, polypropylene, etc., at both the surfaces thereof are preferably used.

As a carbon black which is used for the foregoing purpose, those prepared by any optional method such as a channel method, a thermal method, a furnace method, etc., as described in Donnel Vost, *Carbon Black*, published by Marcel Dekker, Inc., 1976, are suitable.

There is no particular restriction in regard to the particle size of carbon black, but carbon black having a particle size of from about 90 to about 1800 Å is preferred. The addition amount of the black pigment as a light shading agent may be controlled according to the sensitivity of the light-sensitive material being shaded but is preferably an amount which provides an optical density of from about 5 to about 10.

When the black support is used or the whiteness of the white support is deficient, it is necessary to form a white light reflection layer between the support and the dye-receiving layer. In this case, it is preferable to form a layer containing a white pigment such as titanium oxide, barium sulfate, lead oxide, etc., having a particle size of from about 0.1 μm to about 5 μm or a hollow polymer latex.

(B) Layer having Neutralizing Function

A layer having a neutralizing function for use in this invention is a layer containing a sufficient amount of an acidic material for neutralizing alkalis carried from a processing composition and, if necessary, may have a multilayer structure composed of a neutralization rate controlling layer (timing layer), an adhesion strengthening layer, etc.

A preferred acidic material is a material having an acidic group having a pKa of less than about 9 (or a precursor giving such an acidic group by hydrolysis), and as a more preferred acidic material, the higher fatty acids such as oleic acid as described in U.S. Pat. No. 2,983,606; the polymer of acrylic acid, methacrylic acid or maleic acid, and the partial ester or acid anhydride thereof as disclosed in U.S. Pat. No. 3,362,819; the copolymer of acrylic acid and an acrylic acid ester as disclosed in French Patent 2,290,699; and the latex type acidic polymers as disclosed in U.S. Pat. No. 4,139,383 and *Research Disclosure*, No. 16102 (1977) can be used.

Other acidic materials disclosed in U.S. Pat. No. 4,088,493, JP-A-52-153739, JP-A-53-1023, JP-A-53-4540, JP-A-53-4541, and JP-A-53-4542 can also be used.

Practical examples of the acidic polymer are a copolymer of a vinyl monomer such as vinyl acetate, vinyl methyl ether, etc., and maleic anhydride, the n-butyl ester of the copolymer, a copolymer of butyl acrylate and acrylic acid, cellulose acetate, hydrogen phthalate, etc.

The foregoing acidic polymer can be used singly or as a mixture with a hydrophilic polymer. As such a hydrophilic polymer, polyacrylamide, polyvinyl-pyrrolidone, polyvinyl alcohol (including the partially saponified one), carboxymethyl cellulose, hydroxymethyl cellulose, hydroxyethyl cellulose, polymethyl vinyl ether, etc., can be used. Of these polymers, polyvinyl alcohol is preferred.

Also, the foregoing acidic polymer may be used in a mixture with cellulose acetate, etc.

The coating amount of the acidic polymer is controlled according to the amount of the alkali being spread over the light-sensitive element. The equivalent ratio of the acidic polymer to the alkali per unit area is preferably from about 0.9 to about 2.0. If the amount of the acid polymer is too small, the color hue of the transferred dye is changed and stains form in the background portions. If the amount thereof is too large, the change of the color hue and the reduction of light fastness of the transferred dye occur. The equivalent ratio is more preferably from about 1.0 to about 1.3.

In the case of mixing the polymer acid with a hydrophilic polymer, if the amount of the hydrophilic polymer is too large or too small, the quality of the photograph which is formed is reduced. The ratio of the hydrophilic polymer to the polymer acid is from 0.1 to 10, and preferably from 0.3 to 3.0.

The layer having the neutralizing function for use in this invention can contain additives for various purposes. For example, the layer can contain a hardening agent for hardening the layer and a polyhydric hydroxyl compound such as polyethylene glycol, polypropylene glycol, glycerol, etc., for improving the brittleness of the layer. Also, if necessary, the layer can contain an antioxidant, a development inhibitor or a precursor thereof, etc.

(C) Neutralization Timing Layer

For the timing layer which is used in combination with the neutralization layer, polymers which reduce alkali permeability, such as gelatin, polyvinyl alcohol, a partially acetylated product of polyvinyl alcohol, cellulose acetate, partially acetylated polyvinyl acetate, etc.; latex polymers which increase the activation energy of alkali permeability formed by copolymerizing a small amount of a hydrophilic comonomer such as an acrylic acid monomer, etc.; and polymers having a lactone ring are useful.

In these materials, the timing layers using cellulose acetate disclosed in JP-A-54-136328, U.S. Pat. Nos. 4,267,262, 4,009,030, and 4,029,849, etc.; the latex polymers prepared by copolymerizing a small amount of a hydrophilic comonomer such as acrylic acid disclosed in JP-A-54-128335, JP-A-56-69629, and JP-A-57-6843, U.S. Pat. Nos. 4,056,394, 4,061,496, 4,199,362, 4,250,243, 4,256,827, and 4,268,604, etc.; the polymers having a lactone ring disclosed in U.S. Pat. No. 4,229,516; and the polymers disclosed in JP-A-56-25735, JP-A-56-97346, JP-A-57-6842, European Patents (EP) 31,957A1, 37,724A1, and 48,412A1, etc., are particularly useful.

Other polymers which can be used for the neutralization timing layer in this invention are described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, West German Patent Applications (OLS) 1,622,936 and 2,162,277, *Research Disclosure*, No. 15162, 151 (1976) , JP-A-59-202463, U.S. Pat. Nos. 4,297,431, 4,288,523, 4,201,587, and 4,229,516, JP-A-55-121438, JP-A-56-166212, JP-A-55-41490, JP-A-55-54341, JP-A-56-102852, JP-A-57-141644, JP-A-56-102852, JP-A-57-141644, JP-A-57-173834, and JP-A-57-179841, West German Patent Application (OLS) 2,910,271, European Patent Application (EP) 31957A1, and *Research Disclosure*, No. 18452.

The neutralization timing layer may be a single layer or plural layers.

Also, the timing layer composed of the foregoing materials may further contain the development inhibitors and/or the precursors thereof disclosed in U.S. Pat. No. 4,009,029, West German Patent Applications (OLS) 2,913,164 and 3,014,672, JP-A-54-155837 and JP-A-55-138745, etc., or the hydroquinone precursors disclosed in U.S. Pat. No. 4,201,578 and other photographically useful additives or the precursors thereof.

(D) Dye Image-Receiving Layer

The dye image-receiving layer for use in the present invention contains a mordant in a hydrophilic colloid layer. The layer may be a single layer or a multilayer structure formed by coating mordants each having a different mordanting power in plural layers. These layers are described in JP-A-61-252551.

As the mordant, a polymer mordant is preferably used.

The polymer mordant for use in the present invention is a polymer having a secondary or tertiary amino group, a polymer having a nitrogen-containing heterocyclic moiety, a polymer having a quaternary cation group, etc., each having a molecular weight of at least 5,000, and particularly preferably at least 10,000.

Examples of the polymer mordant are the vinylpyridine polymers and vinylpyridinium cation polymers disclosed in U.S. Pat. Nos. 2,548,564, 3,484,430, 3,148,061, and 3,756,814; the vinylimidazolium cation polymers disclosed in U.S. Pat. No. 4,124,386; the polymer mordant crosslinkable with gelatin, etc., disclosed in U.S. Pat. Nos. 3,625,694, 3,859,096, and 4,128,538, and British Patent 1,277,453; the water-soluble sol type mordants disclosed in U.S. Pat. Nos. 3,958,995, 2,721,852, and 2,798,063, JP-A-54-115228, JP-A-54-145529, JP-A-54-126027, JP-A-54-155835, and JP-A-56-17352; the water-insoluble mordants disclosed in U.S. Pat. No. 3,898,088; the reactive mordants which can form a covalent bond with a dye disclosed in U.S. Pat. Nos. 4,168,976 and 4,201,840; and the mordants disclosed in U.S. Pat. Nos. 3,709,690, 3,788,855, 3,642,482, 3,488,706, 3,557,066, 3,271,147, and 3,271,148, JP-A-53-30328, JP-A-52-155529, JP-A-53-125, JP-A-53-1024, JP-A-53-107835, and British Patent 2,064,802.

Furthermore, the mordants described in U.S. Pat. Nos. 2,675,316 and 2,882,156 can be also used in the present invention.

In the foregoing mordants, a mordant which does not readily transfer from the mordant layer to another layer or other layers is preferable. For example, the mordants causing a crosslinking reaction with a matrix such as gelatin, etc., the water-insoluble mordants, and the water-soluble sol (or latex dispersion) type mordants are preferred. The latex dispersion type mordants are particularly preferred, and the particle sizes of the latex dispersion type mordant are from about 0.01 to about 2 μm, and preferably from 0.05 to 0.2 μm.

The coating amount of the mordant depends upon the kind of mordant, the content of a quaternary cation, the kind and amount of the dye being mordanted, the kind of binder being used, etc., but it is usually from about 0.5 to about 10 g/m$^2$, preferably from 1.0 to 5.0 g/m$^2$, and particularly preferably from 2 to 4 g/m$^2$.

As a hydrophilic colloid suitable for the image receiving layer, gelatin, polyvinyl alcohol, polyacrylamide, polyvinylpyrrolidone, etc., are used, but gelatin is preferably used.

The image-receiving layer may contain a fading inhibitor. As the fading inhibitor, there are, for example, antioxidants, ultraviolet absorbents, and certain kinds of metal complexes. They are substantially contained in the image-receiving layer, but if the effect thereof is obtained, they can exist in another layer.

As the antioxidant, suitable examples include chroman series compounds, coumaran series compounds, phenolic compounds (e.g., hindered phenols), hydroquinone derivatives, hindered amine derivatives, and spiroindane series compounds. Also, the compounds described in JP-A-61-159644 are effective.

As the ultraviolet absorbents, there are benzotriazole series compounds described in U.S. Pat. No. 3,533,794, 4-thiazolidone series compounds described in U.S. Pat. No. 3,352,681, benzophenone series compounds described in JP-A-46-2784, and the compounds described in JP-A-54-48535, JP-A-62-136641, and JP-A-61-88256. Also, the ultraviolet absorptive polymers described in JP-A-62-260152 can be effectively used.

As the metal complexes for use in the present invention, suitable examples include the compounds described in U.S. Pat. Nos. 4,241,155, 4,245,018, columns 3–36, and 4,254,195, column 3–8, JP-A-62-174741, JP-A-61-88256, pages 27–29, JP-A-1-75568, and JP-A-63-199248.

Examples of suitable fading inhibitors for use in the present invention are described in JP-A-62-215272, pages 125–137.

The fading inhibitor for inhibiting fading of the dye transferred into the image-receiving element may previously be present in the image-receiving element or may be supplied to the image-receiving element from an outside source such as from a processing composition.

The foregoing antioxidant, ultraviolet absorbent, and metal complex may be used in combination with each other.

In the light-sensitive element and the image-receiving element in the present invention, an optical whitening agent may be used. In particular, it is preferred that the optical whitening agent is incorporated in the image-receiving element or in the light-sensitive element or the processing composition and is supplied therefrom to the image-receiving element during the processing step. As an example thereof, the compounds described in K. Veenkataraman, *The Chemistry of Synthetic Dyes*, Vol. V, Chapter 8, and JP-A-61-143752 can be used. More practically, there are stilbene series compounds, coumarin series compounds, biphenyl series compounds, benzoxazolyl series compounds, naphthalimide series compounds, pyrazolidone series compounds, and carbostyryl series compounds.

Furthermore, a combination of an optical whitening agent and a fading inhibitor can be used in the present invention.

(E) Releasing Layer

In this invention, if necessary, a releasing layer is formed for releasing the image-receiving element from the light-sensitive element after processing. Accordingly, the releasing layer must be easily released after processing. As the material for the releasing layer, the materials described in JP-A-47-8237, JP-A-59-22727, JP-A-59-229555, JP-A-49-4653, U.S. Pat. Nos. 3,220,835 and 4,359,518, JP-A-49-4334, JP-A-56-65133, and JP-A-45-24075, and U.S. Pat. Nos. 3,227,550, 2,759,825, 4,401,746, and 4,366,227 can be used. As a practical example, a water-soluble (or alkali-soluble) cellulose derivative can be used. For example, hydroxyethyl cellulose, cellulose acetate phthalate, plasticized methyl cellulose, ethyl acetate, cellulose nitrate, and carboxymethyl cellulose can be used. Other examples thereof are various natural high molecular weight materials such as alginic acid, pectin, gum arabic, etc. Also, various modified gelatins such as acetylated gelatin, phthalated gelatin, etc., can be used.

Furthermore, as other examples thereof, water-soluble synthetic polymers such as, for example, polyvinyl alcohol, polyacrylate, polymethyl methacrylate, polybutyl methacrylate, and the copolymers thereof can be used.

The releasing layer may be a single layer or may be composed of plural layers as described, e.g., in JP-A-59-220727 and JP-A-60-60642.

(F) Light-Sensitive Layer

In the present invention, a light-sensitive layer composed of at least one silver halide emulsion layer combined with at least one dye image-forming material is formed.

Various aspects relating to the light-sensitive layer are described below.

(1) Dye Image-Forming Material:

The dye image-forming material (hereinafter referred to as a reducible dye-providing compound) for use in this invention is a material which releases a dye upon reduction in connection with silver development. This compound is used in combination with an electron donor and can imagewise release a diffusible dye by reaction with an electron donor which was imagewise oxidized by silver development. Atomic groups having such a function are described, e.g., in U.S. Pat. Nos. 4,183,753, 4,142,891, 4,278,750, 4,139,379, 4,218,368, 4,278,750, 4,356,249, 4,358,525, and 4,783,396, JP-A-53-110827, JP-A-53-110827, JP-A-54-130927, and JP-A-56-164342, Kokai Giho 87–6199, and European Patent Publication (unexamined) 220,746A2.

The reducible dye-providing compound for use in this invention is preferably a compound represented by formula (C-I).

$$\text{PWR - (Time)}_t\text{- Dye} \qquad \text{(C-I)}$$

wherein PWR represents a group capable of releasing -(Time)$_t$-Dye upon being reduced; Time represents a group capable of releasing Dye through a subsequent reaction after being released as -(Time)$_t$-Dye from PWR; t represents 0 or 1; and Dye represents a dye or a dye precursor.

PWR is explained in detail below.

PWR may correspond to the moiety containing an electron accepting center and an intramolecular nucleophilic substitution reaction center in the compound capable of releasing a photographically useful reagent by an intramolecular substitution reaction after being reduced as disclosed in U.S. Pat. Nos. 4,139,389, 4,139,379, and 4,564,577, JP-A-59-185333 and JP-A-57-84453, or it may correspond to a moiety containing an electron accepting quinonoid center and the carbon atom bonding the quinonoid center to a photographic reagent in the compound capable of releasing the photographic reagent by an intramolecular electron transfer reaction after being reduced as disclosed in U.S. Pat. No. 4,232,107, JP-A-59-101659 and JP-A-61-88257, and *Research Disclosure*, No. 24025, IV (1984).

Also, PWR may correspond to a moiety containing an aryl group substituted with an electron attracting group and the atom (a sulfur atom, a carbon atom, or a nitrogen atom) bonding the aryl group to a photographic reagent in the compound capable of releasing the photographic reagent by the cleavage of a single bond after being reduced as disclosed in JP-A-56-142530 and U.S. Pat. Nos. 4,343,893 and 4,619,884. Furthermore, PWR may correspond to a moiety containing a nitro group and the carbon atom bonding the nitro group to a photographic reagent in the compound capable of releasing the photographic reagent after receiving an electron as disclosed in U.S. Pat. No. 4,450,223, or it may correspond to a moiety containing a dinitro group and the carbon atom bonding the dinitro group to a photographic reagent in the compound capable of beta-releasing the photographic reagent after receiving an electron as described in U.S. Pat. No. 4,609,610.

Also, as PWR, a compound —$SO_2$—X (wherein X represents oxygen, sulfur or nitrogen) and an electron attracting group in one molecule as described in U.S. Pat. No. 4,840,887, a compound having PO-X (wherein X is same as described above) and an electron attracting group in one molecule as described in JP-A-63-271344, and a compound having C-X′ (X′ has the same meaning as X described above or —$SO_2$—) and an electron attracting group in one molecule as described in JP-A-63-271341 can be used.

For sufficiently attaining the objects of this invention, among the compounds represented by the foregoing formula (C-I), the compounds represented by formula (C-II) can be used.

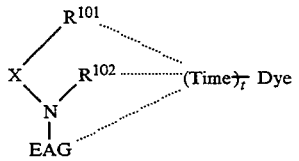

(C-II)

(Time)$_t$ Dye is bonded to at least one of $R^{101}$, $R^{102}$, and EAG.

The moiety of formula (C-II) corresponding to PWR is explained below in further detail.

In formula (C-II), X represents an oxygen atom (—O—), a sulfur atom (—S—), or a group containing a nitrogen atom (—N($R^{103}$)—), and $R^{101}$, $R^{102}$, and $R^{103}$ each represents a group other than a hydrogen atom or a simple bond.

Examples of the group other than a hydrogen atom represented by $R^{101}$, $R^{102}$ and $R^{103}$ include an alkyl group and an aralkyl group, each of which may be substituted, such as methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl) ethyl, carboxyethyl, allyl, 3,3,3-trichloropropyl, n-propyl, iso-propyl, n-butyl, iso-butyl, sec-butyl, t-butyl, n-pentyl, sec-pentyl, t-pentyl, cyclo-pentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, t-octadecyl, etc., an alkenyl group which may be substituted, such as vinyl, 2-chlorovinyl, 1-methylvinyl, 2-cyanovinyl, cyclohexene-1-yl, etc. , an alkynyl group which may be substituted, such as ethynyl, 1-propynyl, 2-ethoxycarbonylethynyl, etc., an aryl group which may be substituted, such as phenyl, naphthyl, 3-hydroxyphenyl, 3-chlorophenyl, 4-acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, 4-tetradecyloxyphenyl, etc., a heterocyclic group which may be substituted, such as 1-imidazolyl, 2-furyl, 2-pyridyl, 5-nitro-2-pyridyl, 3-pyridyl, 3,5-dicyano-2-pyridyl, 5-tetrazolyl, 5-phenyl-l-tetrazolyl, 2-benzthiazole, 2-benzimidazolyl, 2-benzoxazolyl, 2-oxazolin-2-yl, morpholino, etc. , an acyl group which may be substituted, such as acetyl, propionyl, butyroyl, isobutyroyl, 2,2-dimethylpropionyl, benzoyl, 3,4-dichlorobenzoyl, 3-acetylamino-4-methoxybenzoyl, 4-methylbenzoyl, 4-methoxy-3-sulfobenzoyl, etc., a sulfonyl group which may be substituted, such as methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, 4-n-dodecyloxybenzenesulfonyl, etc., a carbamoyl group which may be substituted, such as carbamoyl, methylcarbamoyl, dimethylcarbamoyl, bis-(2-methoxyethyl) carbamoyl, diethylcarbamoyl, cyclohexylcarbamoyl, di-n-octylcarbamyl, 3-dodecyloxypropylcarbamoyl, hexadecylcarbamoyl, 3-(2,4-di-t-pentylphenoxy)propylcarbamoyl, 3-octanesulfonylaminophenylcarbamoyl, di-n-octadecylcarbamoyl, etc., and a sulfamoyl group which may be substituted, such as sulfamoyl, methylsulfamoyl, dimethylsulfamoyl, diethylsulfamoyl, bis-(2-methoxyethyl) sulfamoyl, di-n-butylsulfamoyl, methyl-n-octylsulfamoyl, methyl-n-octylsulfamoyl, n-hexadecylmethylsulfamoyl, 3-ethoxypropylmethylsulfamoyl, N-phenyl-N-methylsulfamoyl, 4-decyloxyphenylsulfamoyl, methyloctadecylsulfamoyl, etc.

$R^{101}$ and $R^{103}$ each is preferably an alkyl group, an alkenyl group, an alkynyl group, an aryl group, a heterocyclic group, an acyl group, or a sulfonyl group, and each group can be substituted. Also, it is preferred that the number of carbon atoms in $R^{101}$ and $R^{103}$ is from 1 to 40.

$R^{102}$ is preferably a substituted or unsubstituted acyl group or a substituted or unsubstituted sulfonyl group. The number of carbon atoms in $R^{102}$ is preferably from 1 to 40.

$R^{101}$, $R^{102}$, and $R^{103}$ may be combined with each other to form a 5- to 8-membered ring.

X is particularly preferably oxygen.

EAG will be described below.

Furthermore, for attaining the objects of this invention, among the compounds represented by formula (C-II), the compounds represented by formula (C-III) are preferred.

(C-III)

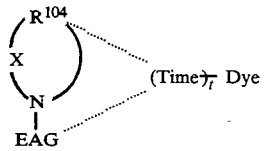

$(Time)_t$Dye is bonded at least one of $R^{104}$ and EAG.

X has the same meaning as described above.

$R^{104}$ represents an atomic group which is bonded to X and the nitrogen atom to form a 5- to 8-membered single ring or condensed heterocyclic ring each containing the nitrogen atom.

In formulae (C-II) and (C-III), EAG represents a group receiving an electron from a reducing material and is bonded to the nitrogen atom. EAG is preferably the group represented by formula (A):

(A)

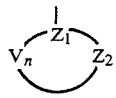

wherein $Z_1$ represents

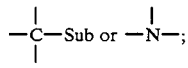

$V_n$ represents an atomic group forming a 3- to 8-membered aromatic ring with $Z_1$ and $Z_2$; and n represents an integer of from 1 to 6.

$V_n$ is as follows:

$V_3$ is $-Z_3-$, $V_4$ is $-Z_3-Z_4-$, $V_5$ is $-Z_3-Z_4-Z_5-$, $V_6$ is $-Z_3-Z_4-Z_5-Z_6-$, $V_7$ is $-Z_3-Z_4-Z_5-Z_6-Z_7-$, and $V_8$ is $-Z_3-Z_4-Z_5-Z_6-Z_7-Z_8-$.

$Z_2$, $Z_3$, $Z_4$, $Z_5$, $Z_6$, $Z_7$, and $Z_8$ each represents

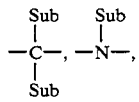

—O—, —S—, or $—SO_2—$; and Sub represents a simple bond ($\pi$bond), a hydrogen atom, or a substituent as shown below.

When two Subs are present, they may be the same or different or may combine with each other to form a 3- to 8-membered saturated or unsaturated carbon ring or a heterocyclic ring.

In formula (A) described above, the substituent represented by "Sub" is selected such that the para of the Hammett's substituent constant of the substituent becomes at least +0.50, preferably at least +0.70, and most preferably +0.85.

EAG is preferably an aryl group or a heterocyclic group substituted by at least one electron attracting group. The substituent bonded to the aryl group or the heterocyclic group shown by EAG can be utilized to control the properties of the whole compound. For example, the substituent can control the ability to receive an electron, and it can control the water solubility, oil solubility, diffusibility, volatility, reactivity to a nucleophilic group, and reactivity to an electrophilic group.

Practical examples of EAG are described in U.S. Pat. No. 4,783,396 and European Patent Publication (unexamined) 220,746A2, pages 6 to 7.

Time represents a group releasing Dye via a subsequent reaction with the cleavage of a nitrogen-oxygen bond, a nitrogen-nitrogen bond, or a nitrogen-sulfur bond as a trigger.

Various groups which can be used as Time are known, and examples of Time as well as the subsequent reaction for releasing Dye from $-(Time)_t$-Dye are described in JP-A-61-147244, pages 5-6, JP-A-61-236549, pages 8-14, and JP-A-62-215270.

The dye represented by Dye may be a dye itself or a dye precursor which can be converted to a dye in a photographic processing step or an additional processing step. Also, the final image dye may or may not be metal chelated. As typical dyes, metal chelated dyes or dyes which are not metal chelated, such as azo dyes, azomethine dyes, anthraquinone dyes, phthalocyanine dyes, etc., can be used. In these dyes, azoic cyan, magenta, and yellow dyes are particularly useful.

Practical examples of the yellow coupler are described in U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930, JP-A-56-71072, *Research Disclosure*, No. 17630 (1978), and ibid., No. 16475 (1977).

Practical examples of the magenta dye are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, JP-A-52-106727, JP-A-53-23628, JP-A-55-36804, JP-A-56-73057, JP-A-56-71060, and JP-A-55-134.

Practical examples of the cyan dye are described in U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-56-71061, European Patents (EPC) 53,037 and 53,040, *Research Disclosure*, No. 17630 (1978) and ibid., No. 16475 (1977) .

As one kind of dye precursor, a non-diffusible dye providing material bonded with a dye in which the absorption spectrum is temporarily shifted upon storage and exposure of the light-sensitive material can be used. The term "a dye in which the absorption spectrum is temporarily shifted" (hereinafter referred to as a temporarily shifted dye) means a dye in which the absorption spectrum is changed to a different absorption spectrum from the original absorption spectrum observed as an image. The temporarily shifted dye may become the dye having the original absorption spectrum simultaneously when the dye is released from the non-diffusible dye providing material, at the time of development of the light-sensitive material independently from the release thereof, or when the dye reaches an image-receiving layer by diffusion.

As dyes suitable for this invention, yellow dyes, magenta dyes, cyan dyes, black dyes, etc. can be used, and these dyes are structurally classified into nitro and nitroso dyes, azo dyes (benzeneazo dyes, naphthaleneazo dyes, heterocyclic azo dyes, etc.), stilbene dyes, carbonium dyes (diphenylmethane dyes, triphenylmethane dyes, xanthene dyes, acridine dyes, etc.), quinoline dyes, methine dyes (polymethine dyes, azomethine dyes, etc.), thiazole dyes, quinoneimine dyes (azine dyes dyes, oxazine dyes, thiazine dyes, etc.), lactone dyes, aminoketone dyes, hydroxyketone dyes, anthraquinone dyes, indigo dyes, thioindigo dyes; phthalocyanine dyes, etc. Preferred temporarily shifted dyes are azo dyes, carbonium dyes, anthraquinone dyes, methine dyes, and quinoneimine dyes, and particularly preferred dyes are azo dyes.

To obtain a temporarily shifted dye suitable for this invention, a method of converting a dye into a 2 electron reductant to perform a hypsochromic shift of the original absorption spectrum of the dye and oxidizing the reductant of the dye during the development process or after the development process to shift to the original absorption spectrum (azo dyes, anthraquinone dyes, methine dyes, quinoneimine dyes, indigo dyes, etc.), a method of chemically blocking the auxochrome of a dye to perform a hypsochromic shift of the original absorption spectrum and removing the blocking during the development process to shift to the original absorption spectrum [chemical blocking method] (azo dyes, carbonium dyes, methine dyes, etc.), and a method of chelating a dye with a metal ion after reaching an image-receiving layer to convert to a dye having a desired absorption spectrum [post chelating method] (azo dyes, methine dyes, phthalocyanine dyes, etc.) can be used. In this invention, the chemical blocking method and the post chelating method are preferably used.

These methods are known as described below. That is, in regard to the method of chemically blocking the auxochrome, examples in which the release of the dye and the removal of the blocking of the auxochrome of the dye occur independently are described in JP-A-57-158638, JP-A-55-53329, JP-A-55-53330, etc., and examples of other more general blocking methods are described in U.S. Pat. Nos. 4,009,029, 4,310,612, 3,674,478, 3,932,480, 3,993,661, 4,335,200, 4,363,865, 4,410,618, etc. Also, suitable examples in which the release of the dye and the removal of the blocking of the auxochrome occur simultaneously are described in U.S. Pat. No. 4,783,396.

Examples of the method of chelating a dye with a metal ion after the dye reaches an image-receiving layer to convert the dye to a dye having a desired absorption spectrum are described in JP-A-58-209742, JP-A-58-209741, JP-A-58-17438, JP-A-58-17437, JP-A-58-17436, JP-A-57-1085039, JP-A-57-58149, U.S. Pat. Nos. 4,204,993, 4,148,642, and 4,147,544, JP-A-57-158637, JP-A-58-123537, JP-A-57-181546, JP-A-60-57837, JP-A-57-182738, JP-A-59-208551, JP-A-60-37555, JP-A-59-15448, JP-A-59-149362, and JP-A-59-164553.

The compound shown by the foregoing formula (C-II) or (C-III) is required to be immobile in the photographic layer, and for that purpose, it is desirable that the compound has a ballast group having at least 8 carbon atoms at the position of EAG, $R^{101}$, $R^{102}$, $R^{104}$, or X (in particular, at the position of EAG).

Typical examples of the reducible dye-providing compound for use in this invention are illustrated below, but the invention is not limited to these compounds. For example, the dye-providing compounds described, e.g., in U.S. Pat. No. 4,783,396, European Patent Publication (unexamined) No. 220,746A2, Kokai Giho, 87–6199, etc., can also be used in this invention.

(1)
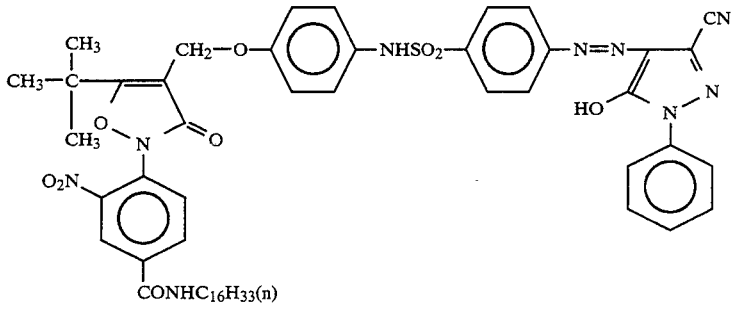
(2)
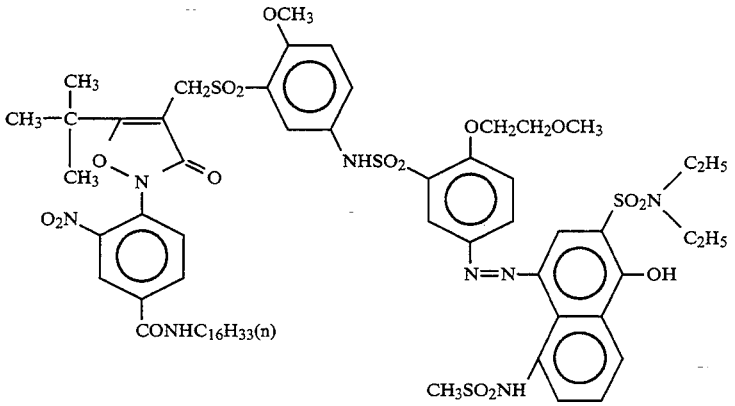
(3)
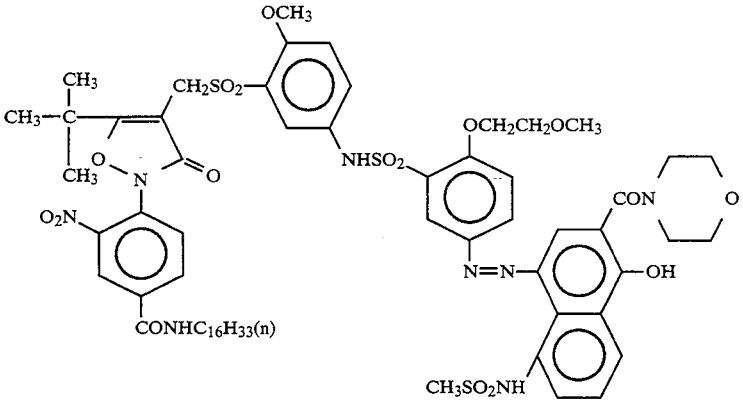
(4)
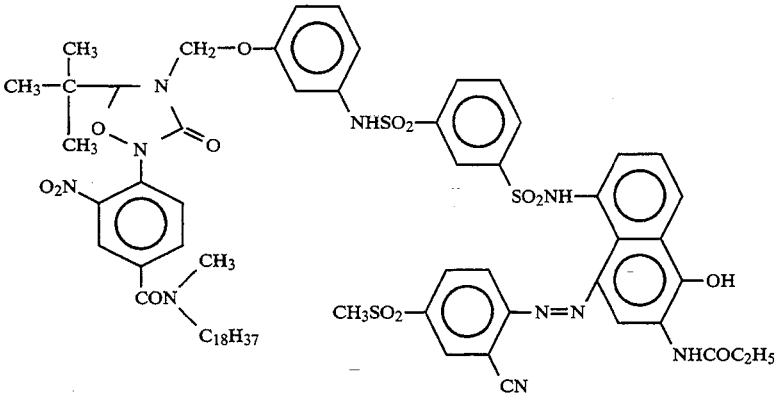

-continued
(5)
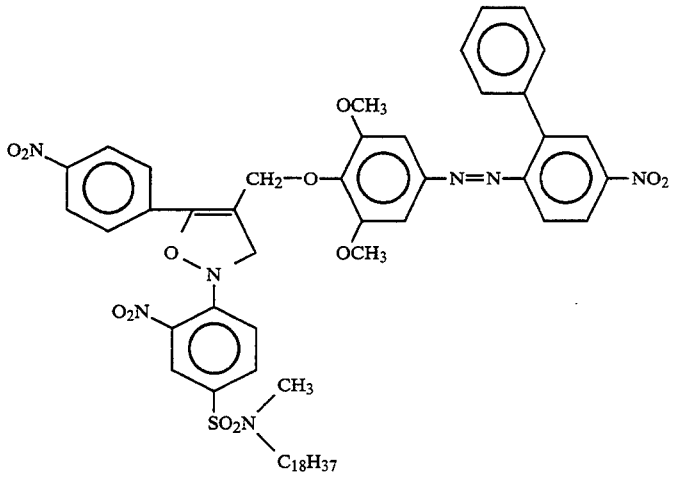
(6)
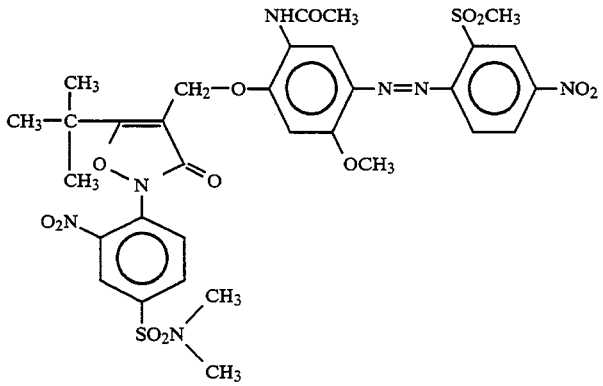
(7)
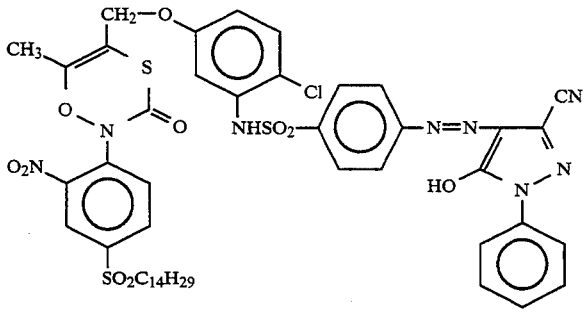
(8)
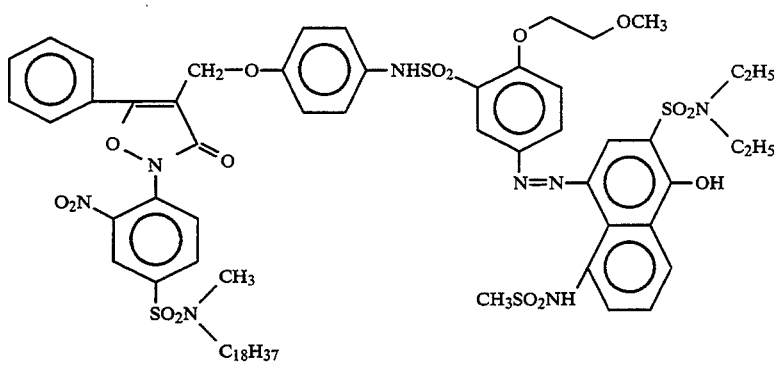

-continued
(9)
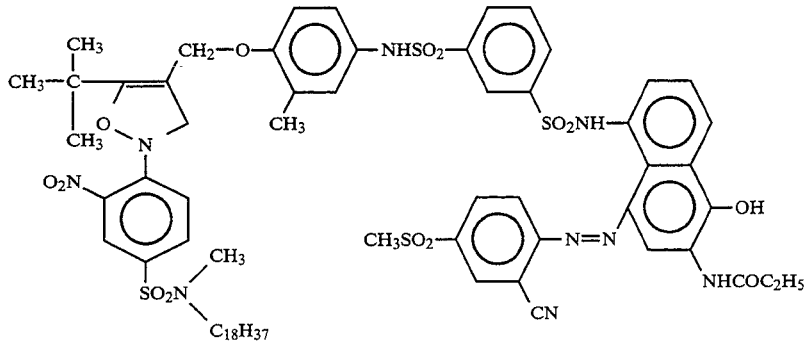
(10)
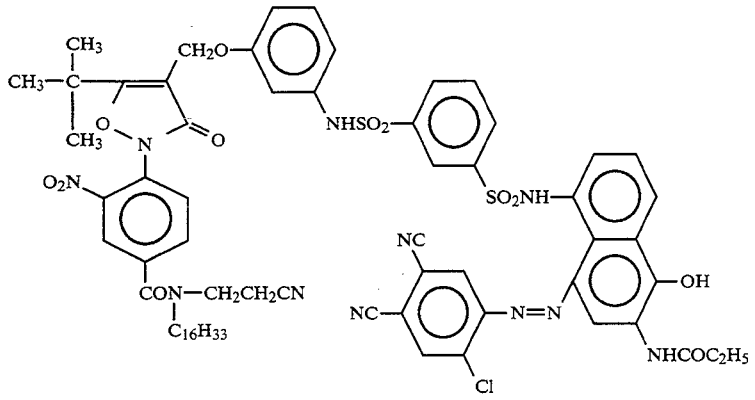
(11)
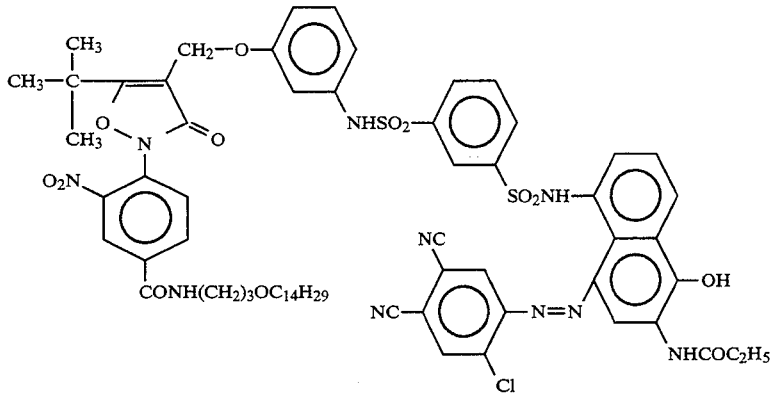
(12)
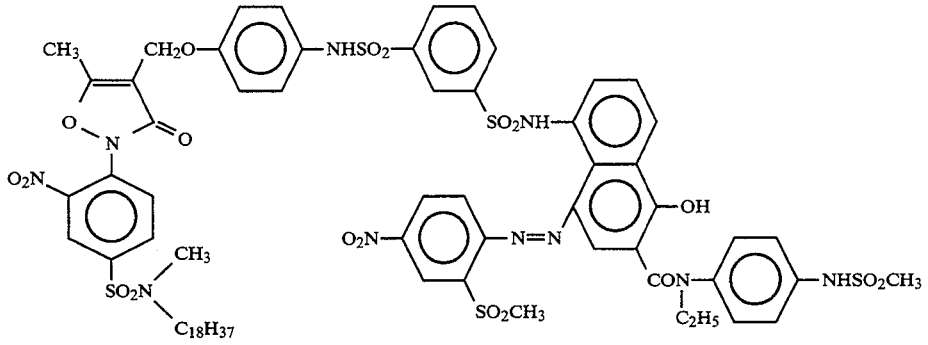

-continued (13)

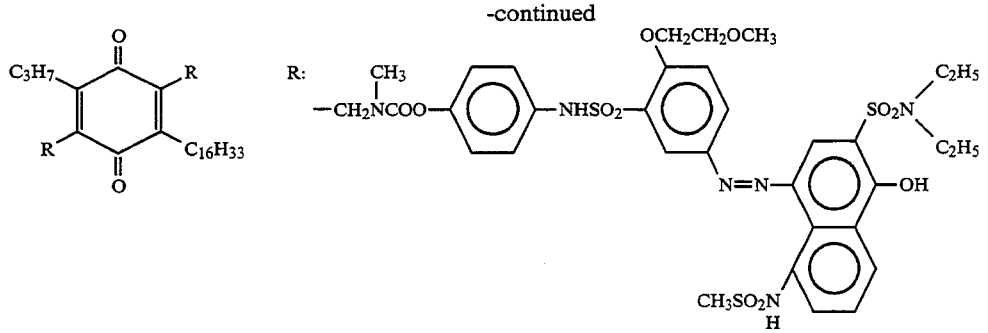

(14)

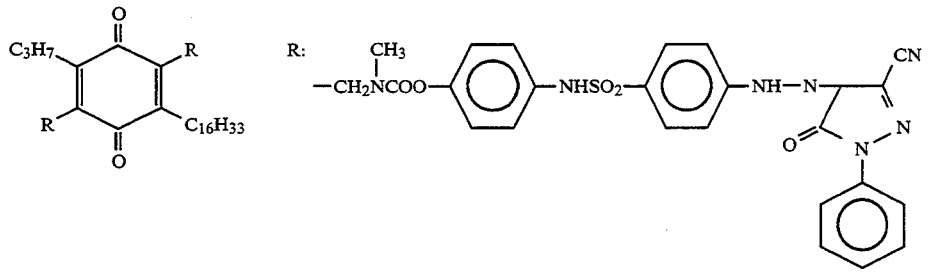

(15)

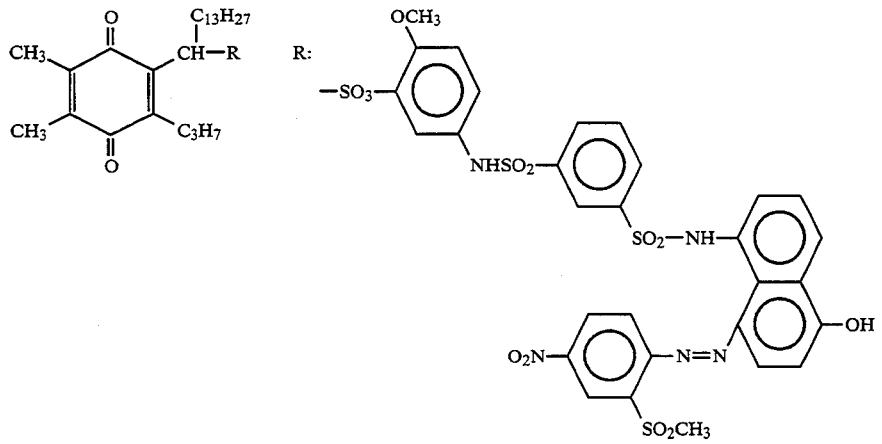

(16)

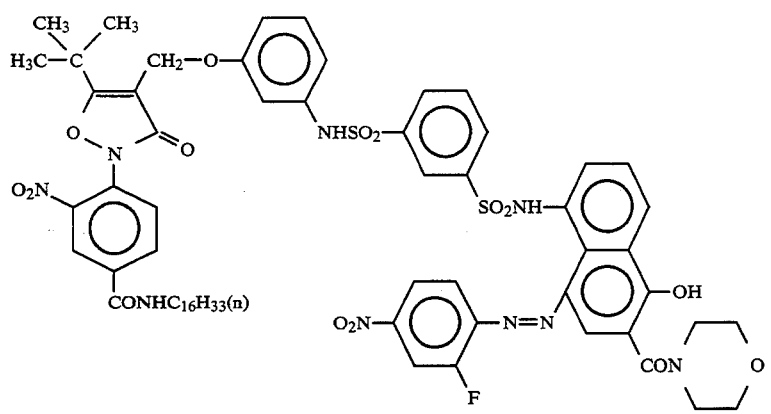

The foregoing compounds can be synthesized by the methods described in the patent specifications set forth above.

The amount of the reducible dye-providing compound depends upon the absorption coefficient of the dye but is generally in the range of from about 0.05 to about 5 mmols/$m^2$, and preferably from 0.1 to 3 mmols/$m^2$.

The dye-providing materials can be used singly or in combination with each other. Also, for obtaining black images or images of a different hue, a mixture of two or more kinds of dye-providing materials releasing mobile dyes each having a different hue can be used, such as in the case of, for example, incorporating a mixture of at least one kind of each of the cyan dye-providing materials, magenta dye-providing materials, and yellow dye-providing materials in a silver halide emulsion layer or a layer adjacent to a silver halide emulsion layer.

(2) Electron Donor:

In this invention, an electron donor (the term "electron donor" in this invention includes the precursor thereof) is used, and details of these compounds are described in U.S. Pat. No. 4,783,396, European Patent Publication (unexamined) 220,746A2, Kokai Giho 87-6199, etc.

A particularly preferred electron donor is the compound represented by formula (C) or (D).

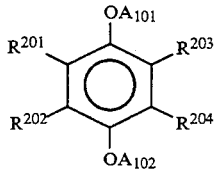

(C)

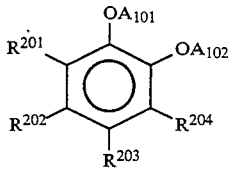

(D)

In the above formulae, $A_{101}$ and $A_{102}$ each represents a hydrogen atom or a protective group for a phenolic hydroxy group capable of being released with a nucleophilic reagent.

As the nucleophilic reagent, anionic reagents such as $OH^-$, $RO^-$ (wherein R represents an alkyl group, an aryl group, etc.), hydroxamic acid anions, $SO_3^{-2}$ and compounds having a non-covalent electron pair such as primary or secondary amines, hydrazine, hydroxylamines, alcohols, thiols, etc. can be used.

When $A_{101}$ and $A_{102}$ in the above formulae each represents a group capable of being removed by an alkali (hereinafter referred to as a precursor group), they preferably are groups capable of being hydrolyzed, such as an acyl group, an alkoxycarbonyl group, an aryloxycarbonyl group, a carbamoyl group, an imidoyl group, an oxazolyl group, a sulfonyl group, etc.; precursor groups of the type utilizing a reverse Michel reaction described in U.S. Pat. No. 4,009,029; precursor groups of the type utilizing the anion formed after a ring cleavage reaction as an intramolecular nucleophilic group described in U.S. Pat. No. 4,310,612; precursor groups in which the anion causes an electron transfer through a conjugated system, thereby causing a cleavage reaction to occur as described in U.S. Pat. Nos. 3,674,478, 3,932,480, and 3,993,661; precursor groups capable of causing a cleavage reaction by the electron transfer of the anion reacted after a ring cleavage described in U.S. Pat. No. 4,335,200; and precursor groups utilizing an imidomethyl group described in U.S. Pat. Nos. 4,363,865 and 4,410,618.

Also, if possible, $A_{101}$ or $A_{102}$ may combined with $R^{201}$, $R^{202}$, $R^{203}$ $R^{204}$ or to form a ring. Furthermore, $A_{101}$ and $A_{102}$ may be the same or different.

In the foregoing formulae (C) and (D), $R^{201}$, $R^{202}$, $R^{203}$ and $R^{204}$ each represents a hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxy group, or a sulfonamido group and the foregoing groups may, if possible, have a substituent.

However, the total number of carbon atoms in all of $R^{201}$ to $R^{204}$ is at least 8.

Also in formula (C), $R^{201}$ $R^{202}$ and/or $R^{203}$ and $R^{204}$ may combine with each other to form a saturated or unsaturated ring, and in formula (D) , $R^{201}$ and $R^{202}$, $R^{202}$ and $R^{203}$, and/or $R^{203}$ and $R^{204}$ may combine with each other to form a saturated or unsaturated ring.

In the electron donors represented by the foregoing formula (C) or (D), it is preferred that at least two of $R^{201}$ to $R^{204}$ are substituents (groups) other than a hydrogen atom. In a particularly preferred compound, at least one of $R^{201}$ and $R^{202}$ and at least one of $R^{203}$ and $R^{204}$ are substituents other than a hydrogen atom.

The electron donors may be used singly or as a mixture thereof, or the electron donor may be used with a precursor thereof.

Specific examples of the electron donor are illustrated below, but the invention is not limited to them.

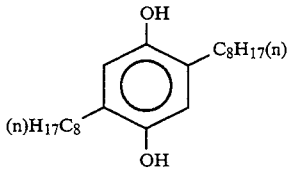

(ED-1)

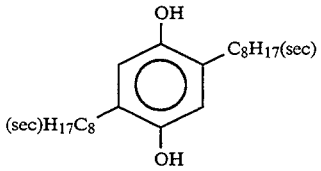

(ED-2)

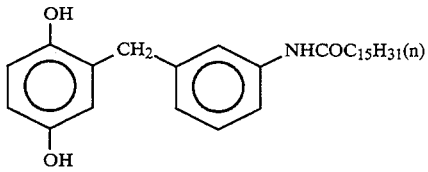

(ED-3)

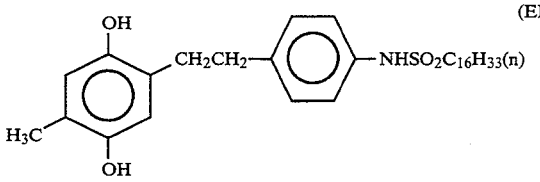

(ED-4)

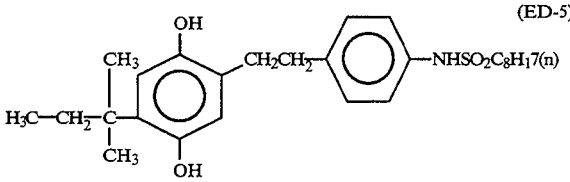

(ED-5)

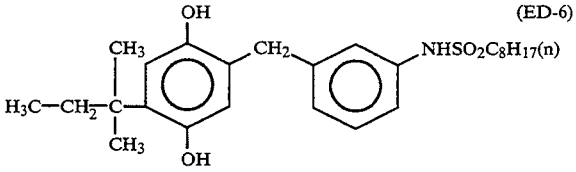

(ED-6)

-continued (ED-7)

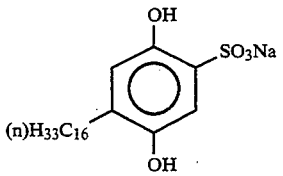

(ED-8)

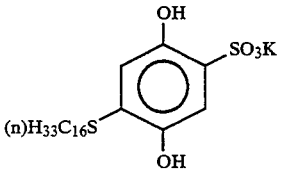

(ED-9)

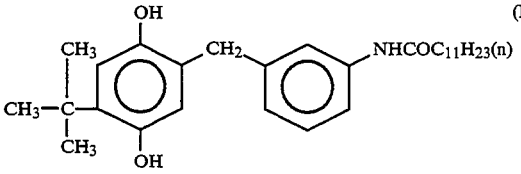

(ED-10)

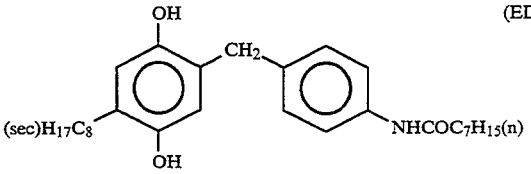

(ED-11)

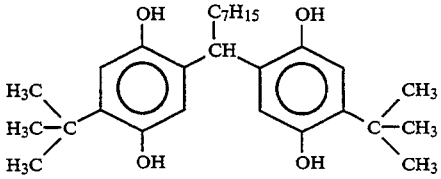

(ED-12)

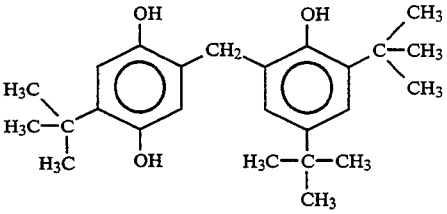

(ED-13)

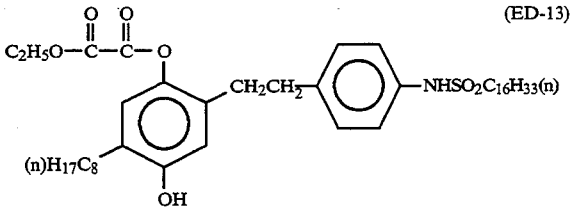

(ED-14)

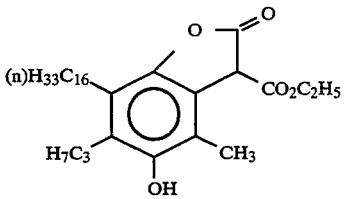

-continued (ED-15)

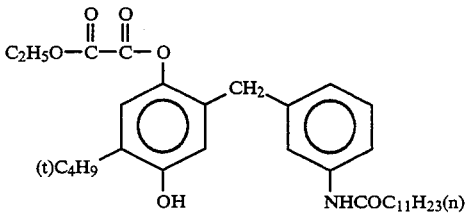

The amount of the electron donor which can be present is in a wide range, but it is preferably in the range of from 0.01 mol to 50 mols, and particularly preferably from about 0.1 mol to about 5 mols per mol of the dye-providing material. Also, the amount of the electron donor is from about 0.001 mol to about 5 mols, and preferably from 0.01 mol to 1.5 mols per mol of silver halide.

(3) Interlayer:

For restraining the formation of stains on the light-sensitive material when forming positive images using the foregoing reducible dye-providing compound, it is effective to use a diffusible electron transporting agent as a reducing agent in addition to the non-diffusible electron donor. In this case, though, the electron transporting agent radical which is formed diffuses into another silver halide emulsion layer having a different color sensitivity to cross-oxidize the electron donor in the layer and further accelerate fog development and reduce the image density, whereby the color reproducibility is reduced.

For solving this problem, an interlayer may be formed between light-sensitive emulsion layers each having different color sensitivities, and a non-diffusible reducing agent may be incorporated in the interlayer.

Practical examples of the non-diffusible reducing agent are non-diffusible hydroquinone, sulfonamidophenol, and sulfonamidonaphthol. Furthermore, specific examples of the non-diffusible reducing agent are described in JP-B-50-21249, JP-B-50-23813, JP-B-49-106326 and JP-B-49-129535, U.S. Pat. Nos. 2,336,327, 2,360,290, 2,403,721, 2,544,640, 2,732,300, 2,782,659, 2,937,086, 3,637,393, and 3,700,453, British Patent 557,750, JP-A-57-24941 and JP-A-58-21249. Also, a dispersing method for the non-diffusible reducing agent is described in JP-A-60-238831 and JP-B-60-18978.

The amount of the non-diffusible reducing agent for the interlayer is in the range of from 0.05 mmol to 50 mmols per square meter of a support and in the range of from 0.01 mmol to 50 mmols per gram of binder in the interlayer.

For adding the non-diffusible reducing agent into the interlayer, an oil dispersion method, a polymer dispersion method, a fine particle dispersion method, etc., may be used.

As a binder for the interlayer in this invention, natural materials such as gelatin, gelatin derivatives, polysaccharides (e.g., cellulose derivatives and dextran), gum arabic, etc., and water-soluble polymers such as polyvinyl acetal (preferably having an acetylation degree of about 20% or lower, e.g., polyvinyl butyral), polyacrylamide, polyvinyl pyrrolidone, ethyl cellulose, polyvinyl alcohol (preferably having a saponification ratio of at least 75%), etc. can be used.

If necessary, a mixture of two or more kinds of these binders may be used.

Furthermore, the interlayer in this invention may contain solid particles. Examples of such solid particles are particles of various white pigments such as titanium dioxide, zinc oxide, calcium oxide, calcium carbonate, magnesium carbonate, barium sulfate, aluminum oxide, silicon dioxide, etc., black pigments such as carbon black, etc., and other organic or inorganic colored pigments. Also, metal powders such as a ferrite powder, an aluminum powder, a copper powder, etc., and a graphite powder can be used.

Also, polymer particles can be used as the solid particles for the interlayer in this invention.

If necessary, a mixture of two or more kinds of these solid particles may be used.

The mean particle size of the solid particles being incorporated in the interlayer is from about 0.005 μm to about 1.0 μm, and preferably from 0.01 μm to 0.5 μm.

The content of the solid particles in the interlayer in this invention is preferably at least about 5% by weight, and more preferably from 20 to 100% by weight based on the weight of a binder in the interlayer.

(4) Addition Method:

For introducing the dye-providing material, the electron donor or the precursor thereof, and other hydrophobic additives in a hydrophilic colloid layer, the method described in U.S. Pat. No. 2,322,027 is used, employing high-boiling organic solvents such as phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and dioctyl azerate), trimesic acid esters (e.g., tributyl trimesate), the carboxylic acids described in JP-A-63-85633, and the compounds described in JP-A-59-83154, JP-A-59-178451, JP-A-59-178452, JP-A-59-178453, JP-A-59-178454, JP-A-59-178455, and JP-A-59-178457, or after dissolving these components in a low-boiling organic solvent having a boiling point of from about 30° C. to 160° C., such as lower alkyl acetates (e.g., ethyl acetate, butyl acetate), ethyl propionate, secondary-butyl alcohol, methyl isobutyl ketone, β-ethoxyethyl acetate, methylcellosolve acetate, cyclohexanone, etc., the solution is dispersed in an aqueous solution of a hydrophilic colloid.

A mixture of the foregoing high-boiling organic solvent and the low-boiling organic solvent may be used. Furthermore, after dispersing the organic solvent solution of the foregoing components in an aqueous hydrophilic colloid solution, if necessary, the low-boiling organic solvent may be removed by ultra-filtration, etc.

The amount of the high-boiling organic solvent is not more than 10 g, and preferably not more than 5 g per gram of the dye-providing material being used, and it also is not more than 5 g, and preferably not more than 2 g per gram of the non-diffusible reducing agent. Furthermore, the amount of the high-boiling organic solvent is not more than 1 g, preferably not more than 0.5 g, and more preferably not more than 0.3 g per gram of binder being used.

Also, a dispersion method with the polymer described in JP-B-51-39853 and JP-A-51-59943 can be used. Furthermore, in other methods, the components may be directly dispersed in a silver halide emulsion, or after dissolving the components in water or an alcohol, the solution may be dispersed in an aqueous gelatin solution or a silver halide emulsion.

In the case of adding a compound substantially insoluble in water, the compound can be dispersed in a binder in the form of fine particles of the compound as described, e.g., in JP-A-59-174830, JP-A-53-102733 and JP-A-63-271339.

When a hydrophobic material is dispersed in an aqueous hydrophilic colloid solution, various surface active agents can be used. For example, the surface active agents described in JP-A-59-157636, pages 37–38 can be used.

(5) Silver Halide Emulsion:

In this invention, the silver halide emulsions described above are used.

The coating amount of the light-sensitive silver halide emulsion in this invention is in the range of from 1 $mg/m^2$ to 10 $g/m^2$ based on silver content.

As a protective colloid used in the preparation of the silver halide emulsion in this invention, gelatin is advantageously used, but other hydrophilic colloids can also be used.

Examples of such hydrophilic colloids are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharide derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

As gelatin, limed gelatin as well as acid-treated gelatin and the enzyme-treated gelatin as described in *Bull. Soc. Sci. Photo. Japan*, No. 16, 30 (1966) can be used. Also, the hydrolyzed product or the enzyme-decomposed product of gelatin can be used.

In this invention, various kinds of antifoggants or photographic stabilizers can be used. Examples thereof are the azoles and azaindenes described in *Research Disclosure*, No. 17643, pages 24 to 25 (1978), the nitrogen-containing carboxylic acids and the phosphoric acids described in JP-A-59-168442, the mercapto compounds and the metal salts described in-JP-A-59-111636, and the acetylene compounds described in JP-A-62-87957.

The silver halide emulsion for use in this invention may be spectrally sensitized with methine dyes, etc. As suitable dyes, cyanine dyes, merocyanine dyes, complex cyanine dyes, complex merocyanine dyes, holopolar cyanine dyes, hemicyanine dyes, styryl dyes, and hemioxonol dyes can be used.

In practice, the sensitizing dyes described in U.S. Pat. No. 4,617,257, JP-A-59-180550, JP-A-60-140335, and *Research Disclosure*, No. 17029, pages 12–13 (1978) can be used.

These sensitizing dyes may be used singly or in combination with each other, and a combination of sensitizing dyes is frequently used for the purpose of supersensitization.

The silver halide emulsion may contain a dye having no spectral sensitizing action by itself or a compound which does not substantially absorb visible light and exhibits supersensitization (e.g., the compounds described in U.S. Pat. No. 3,615,641, JP-A-63-23145, etc.) together with the sensitizing dye or dyes.

At least one sensitizing dye may be added to a silver halide emulsion before, during, or after chemical ripening, or before or after the nucleation of silver halide grains as described in U.S. Pat. Nos. 4,193,756 and 4,225,666. The addition amount of the sensitizing dye is generally from about $10^{-8}$ mol to $10^{-2}$ mol per mol of silver halide.

(6) Constitution of Light-Sensitive Layer:

For the reproduction of natural color by a subtractive color process, at least two light-sensitive layers each composed of the silver halide emulsion spectrally sensitized with at least one of the aforesaid spectral sensitizing dyes combined with the foregoing dye image forming material providing a dye having a selective spectral absorption in the same wavelength region as that of the silver halide emulsion are used. In this case, the silver halide emulsion and the dye image forming material may be coated as separate layers, one upon another, or they may be coated in one layer as a mixture thereof. When the dye image forming material has an absorption in the spectral sensitivity region of the silver halide emulsion combined therewith in the coated state, it is preferable to coat them in separate layers. In this case, it is preferable for purposes of sensitivity that the layer of the reducible dye-providing compound (dye image forming material) is disposed under the silver halide emulsion layer.

Also, the silver halide emulsion layer may be composed of plural emulsion layers each having a different sensitivity. In addition, an optional layer may be formed between the silver halide emulsion layer and the dye image forming material layer.

Furthermore, the color image density can be increased by forming a partition layer as described in JP-B-60-15267, or the sensitivity of the light-sensitive element can be increased by forming a reflection layer as described in JP-A-60-91354.

In a preferred multilayer structure, a combination unit of a blue-sensitive emulsion layer, a combination unit of a green-sensitive emulsion layer, and a combination unit of a red-sensitive emulsion layer are successively disposed to form the light-exposure side.

When the light-sensitive material of this invention is used as a photographing (in camera) light-sensitive material, a ultraviolet absorption layer can be formed on the uppermost layer of the light-sensitive material.

For the ultraviolet absorption layer, various ultraviolet absorbents being generally used in the field of the art, such as benzotriazole series compounds, 4-thiazolidone series compounds, benzophenone series compounds, etc., can be used.

(7) Binder:

As the binder for the constituting layers of the light-sensitive element and the image-receiving element, hydrophilic polymers are preferably used. Examples thereof are described in JP-A-62-253159, pages 26 to 28.

In practice, transparent or translucent hydrophilic binders are preferably used, and, for example, natural compounds such as proteins (e.g., gelatin and gelatin derivatives), cellulose derivatives, polysaccharides (e.g., starch, gum arabic, dextran, and prulan) and synthetic hydrophilic polymers such as polyvinyl alcohol, polyvinylpyrrolidone, acrylamide polymers, etc. can be used.

Also, the high water absorptive polymers described in JP-A-62-245260, that is, the homopolymer of a vinyl monomer having —COOM or —$SO_3M$ (wherein M represents a hydrogen atom or an alkali metal) or a copolymer of the vinyl monomers or the vinyl monomer and another vinyl monomer (e.g., sodium methacrylate, ammonium methacrylate, and Sumika Gel L-5H, trade name, made by Sumitomo Chemical Company, Limited) can be used.

These binders can be used singly or in combination with each other.

In this invention, the coating amount of the binder is preferably not more than 20 g, more preferably not more than 10 g, and particularly preferably not more than 7 g per square meter.

The constituting layers (including back layers) of the light-sensitive element and the image-receiving element can contain various polymer latexes for the purpose of a film or layer property improvement such as dimensional stabilization, curling prevention, sticking prevention, cracking prevention for the layers, prevention of pressure sensitization or pressure desensitization, etc. In practice, the polymer latexes described in JP-A-62-245258, JP-A-62-136648, JP-A-62-110066, etc., can be used. In particular, when a polymer latex having a low glass transition point (not higher than 40° C.) is used for a mordant layer, the occurrence of cracking of the image-receiving layer can be prevented, and when a polymer latex having a high glass transition point is used for a back layer, a curling prevention effect is obtained.

(8) Hardening Agent:

As the hardening agents which are used for the constituting layers of the light-sensitive element and the image-receiving element, the hardening agents described in U.S. Pat. No. 4,678,739, column 41, JP-A-59-116655, JP-A-62-245261 and JP-A-61-18942 are used. In practice, there are, for example, aldehyde series hardening agents (formaldehyde, etc.), azilidine series hardening agents, epoxy series hardening agents

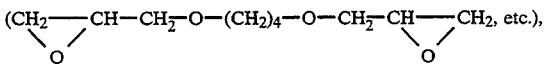

vinylsulfone series hardening agents (N,N'-ethylenebis(vinylsulfonylacetamido)ethane, etc.), N-methylol series hardening agents (dimethylolurea, etc.), and high molecular hardening agents (the compounds described in JP-A-62-234157).

(9) Others:

For the constituting layers of the light-sensitive element and the image-receiving element, various surface active agents can be used as coating aids and for the purposes of improving the releasing property, improving the sliding property, static prevention, development acceleration, etc. Practical examples of the surface active agents are described in JP-A-62-173463 and JP-A-62-183457.

Also, for the constituting layers of the light-sensitive element and the image-receiving element, organic fluoro compounds may be used for the purposes of improving the sliding property, static prevention, improving the releasing property, etc. Typical examples of the organic fluoro compound are the fluorine series surface active agents described in JP-B-57-9053, columns 8 to 17, JP-A-61-20944, JP-A-62-135826, etc., and hydrophobic fluorine compounds such as oily fluorine series compounds (e.g., a fluorine oil) and solid fluorine compound resins (e.g., an ethylene tetrafluoride resin).

For the light-sensitive element and the image-receiving element, a matting agent can be used. As the matting agent, silicon dioxide, polyolefin, and polymethacrylate as described in JP-A-61-88256, page 29 and the compounds described in JP-A-63-27-4944 and JP-A-63-274952, such as benzoguanamine resin beads, polycarbonate resin beads, AS resin beads, etc. can be used.

Furthermore, the constituting layers of the light-sensitive element and the image-receiving element may contain a defoaming agent, an antifungal or antibacterial agent, colloidal silica, etc. Practical examples of these additives are described in JP-A-61-88256, pages 26–32.

In the present invention, an image formation accelerator can be used for the light-sensitive element and/or the image-receiving element. An image formation accelerator has the functions of accelerating the oxidation reduction reaction of a silver salt oxidizing agent and a reducing agent, accelerating reactions such as the formation of a dye from the dye-providing material, the decomposition of the dye, the release of a diffusible dye, etc., and accelerating the transfer of a dye from the light-sensitive material layer into a dye-fixing layer. Based on physicochemical functions, the image formation accelerators are classified as bases or base precursors, nucleophilic compounds, high-boiling organic solvents (oils), surface factlye agents, and compounds having an interaction with silver or a silver ion. However, these materials generally have composite functions and usually have a plurality of the acceleration effects described above. Details thereof are described in U.S. Pat. No. 4,678,739, columns 38 to 40.

(10) Processing Composition:

The processing composition for use in this invention is uniformly spread on the light-sensitive element after image-exposing the light-sensitive element to develop the light-sensitive layer by the components contained therein. For this purpose, the processing composition contains therein an alkali, a thickener, an electron transporting agent (developing agent), and further additives for controlling the development, such as a development accelerator, a development inhibitor, an antioxidant for preventing the deterioration of the developing agent, etc. If necessary, the processing composition can contain a light-shielding agent.

The alkali is used for making the pH of the processing liquid from 12 to 14. Examples thereof are alkali metal hydroxides (e.g., sodium hydroxide, potassium hydroxide, and lithium hydroxide), alkali metal phosphates (e.g., potassium phosphate), guanidines, and hydroxides of quaternary amines (e.g., tetramethyl ammonium hydroxide). In these compounds, potassium hydroxide and sodium hydroxide are preferred.

The thickener is necessary for uniformly spreading the processing liquid, keeping the adhesion between the light-sensitive element and the image-receiving element during development, and preventing the processing liquid components for remaining on the surface of the image-receiving element after it releases from the light-sensitive element.

As the thickener, polyvinyl alcohol, hydroxyethyl cellulose, and an alkali metal salt of carboxymethyl cellulose are used, and preferably hydroxyethyl cellulose and sodium carboxymethyl cellulose are used.

When the image-receiving element has a transparent support and does not have a light-shielding function, the processing composition can contain a light-shielding agent.

As the light-shielding agent, a dye, a pigment, or a combination thereof can be used if they do not diffuse into the dye image-receiving layer to form stains. As a typical light-shielding agent, carbon black is used, but a combination of titanium white and a dye can be used. As such a dye, a temporarily light-shielding dye which becomes colorless after a definite time since processing can be used.

As the electron transporting agent, any material which cross-oxidizes the electron donor and forms substantially no stains when it is oxidized can be used.

Such electron transporting agents may be used singly or in a mixture of two or more kinds thereof. Also, the electron transporting agent may be used in the form of a precursor thereof. As practical examples of the electron transporting agent, aminophenols and pyrazolidinones can be used. Among these compounds, pyrazolidinones are particularly preferred because of decreased formation of stains.

Specific examples of the electron transporting agent are 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone, and 1-p-tolyl-4-methyl-4-hydroxymethyl-3-pyrazolidinone.

It is preferable that the foregoing processing composition is packed in a vessel rupturable by pressure upon use as described in U.S. Pat. Nos. 2,543,181, 2,643,886, 2,653,732, 2,723,051, 3,056,491, 3,056,492, and 3,152,515.

(11) Constitution of Light-Sensitive Material:

By combining the above-described elements, a color diffusion transfer instant photographic light-sensitive material can be produced.

A color diffusion instant film unit can be generally classified into a peel-apart type and a non-peel-apart type.

In the peel-apart type, the light-sensitive layer and the dye image-receiving layer are formed on separate supports, respectively, after imagewise exposure, the light-sensitive element is superposed on the dye image-receiving element, the processing composition is spread between the two elements, and thereafter, by peeling off the light-sensitive element, dye images transferred onto the dye image-receiving layer are obtained.

On the other hand, in the nonpeel-apart type, a dye image-receiving layer and the light-sensitive layer are formed between a transparent support and another support. There is an embodiment in which the image-receiving layer and the light-sensitive layer are formed on a same transparent support and an embodiment in which these layers are formed on separate supports.

In the former embodiment, a white reflection layer is formed between the image-receiving layer and the light-sensitive layer, and in the case of the latter embodiment, by incorporating a white pigment in the processing composition which is spread between the image-receiving layer and the silver halide emulsion layer, the dye images transferred into the image-receiving layer can be observed by reflected light.

In the peel-apart type, the image-receiving element and the light-sensitive element are generally formed on separate supports, and a layer having a neutralizing function, a neutralization timing layer, and a releasing layer in addition to the dye image-receiving layer are formed, if necessary, on the image-receiving material. As the support for the image-receiving material, it is preferable to use a white support having a light-shielding function. On the other hand, a layer having a neutralization function and a neutralization timing layer in addition to the light-sensitive layer are formed on the light-sensitive material, if necessary. As the support for the light-sensitive material, it is preferable to use a black support having a light-shielding function. In regard to the foregoing film unit, the film unit described in JP-A-61-47956 can be used.

Furthermore, as the peel-apart type, the film unit having a dye image-receiving layer, a releasing layer, and a light-sensitive layer formed in that order on the same support as described in JP-A-1-198747 and JP-A-2-282253 can be used.

In the nonpeel-apart type and in the case in which the light-sensitive layer and the image-receiving layer are formed on the same support, a cover sheet having a layer having a neutralization function and a neutralization timing layer formed on a separate transparent support is used. In regard to the aforesaid film unit, the film unit described in JP-B-46-16356 and JP-A-50-13040 can be used.

The present invention is described in further detail below by the following examples, which should not be construed as limiting the present invention in any way. All parts, percents, ratios and the like are by weight unless otherwise stated.

EXAMPLE 1

(1) Preparation of Silver Halide Emulsion:

The preparation methods of tabular grain silver halide emulsions A to D are explained below.

While stirring well an aqueous solution formed by dissolving 6 g of potassium bromide and 30 g of inert gelatin in 3.7 liters of distilled water, an aqueous solution of 14% potassium bromide and an aqueous solution of 20% silver nitrate were added to the aqueous solution by a double jet method over a period of one minute at 55° C. and a pBr of 1.0 (by the end of the addition (addition (I)), 2.40% of the total silver amount was consumed). Then, after adding 300 ml of an aqueous 17% gelatin solution to the mixture followed by stirring at 55° C., an aqueous solution of 20% silver nitrate was added at a constant flow rate until the pBr reached 1.40 (by the end of this addition (addition (II)), 5.0% of the total silver amount was consumed). Then, an aqueous solution of 20% potassium bromide and an aqueous solution of 33% silver nitrate were added to the mixture by a double jet method over a period of 42 minutes and 51 seconds at 55° C. and a pBr of 1.50 (by the end of this addition (addition (III)), 49.6% of the total silver amount was consumed).

Furthermore, an aqueous solution of 20% potassium bromide and an aqueous solution of 33% silver nitrate were added the mixture by a double jet method over a period of 37 minutes and 9 seconds at 55° C. and a pBr of 1.50 (by the end of this addition (addition (IV)), 43% of the total silver amount was consumed).

The amount of silver nitrate used for the silver halide emulsion thus formed was 425 g.

Then, after desalting by an ordinary flocculation method, $Na_2S_2O_3$ and $KAuCl_4$ were added to the emulsion, and the chemical sensitization of the emulsion was carried out most suitably to provide Emulsion-B.

Emulsions-A, C, and D were prepared by controlling the addition time of the addition (I) and the pBr value of the addition (IV).

The preparation methods of comparison emulsions E to G are explained below.

First, solutions I to III shown in Table 1 below were prepared, and by using the solutions, emulsion E was prepared.

TABLE 1

| Aqueous Solution | Aqueous Solution Composition |
|---|---|
| Solution I | Aqueous solution containing 30 g of inert gelatin and 0.07 g of KBr in one liter of water. |
| Solution II | Aqueous solution containing 170 g of $AgNO_3$ in one liter of water. |
| Solution III | Aqueous solution containing 116.2 g of KBr in one liter of water. |

Solution II and Solution III were added to Solution I by a double jet method in stage 1 and stage 2 as shown in Table 2 below while keeping the pAg at 7.1.

TABLE 2

| Stage 1 | | | Stage 2 | | |
|---|---|---|---|---|---|
| Soln. I (ml) | Soln. II (ml) | Addn. Time | Soln. I (ml) | Soln II (ml) | Addn. Time |
| 118 | 118 | 20 min. | 471 | 471 | 40 min. |

After the additions were finished, the emulsion which formed was desalted by a known method, and after adding gelatin thereto, the emulsion was ripened by adding sodium thiosulfate, chloroauric acid, and ammonium rhodanate thereto to provide a silver halide emulsion having a desired sensitivity.

Emulsions F and G were also prepared by controlling the pAg values at 9.2 and 8.7, respectively, in stage 1 and stage 2.

Furthermore, emulsions A to G were most suitably spectrally sensitized with sensitizing dyes S-1 and S-2 shown below in the case of using the emulsion for a red-sensitive emulsion layer, with sensitizing dyes S-3, S-4, and S-5 in the case of using the emulsion for a green-sensitive emulsion layer, and with sensitizing dyes S-6 and S-7 in the case of using as the emulsion for a blue-sensitive emulsion layer to provide the final silver halide emulsions.

Sensitizing Dye S-1:

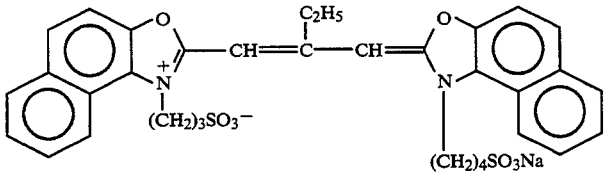

-continued

Sensitizing Dye S-2:

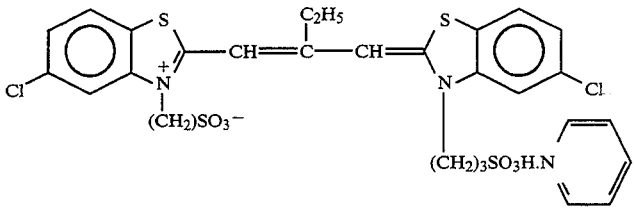

Sensitizing Dye S-3:

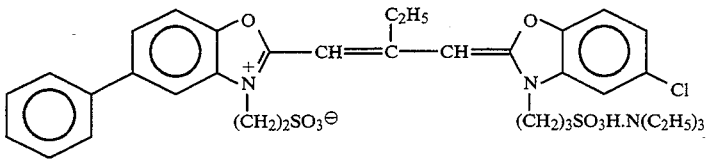

Sensitizing Dye S-4:

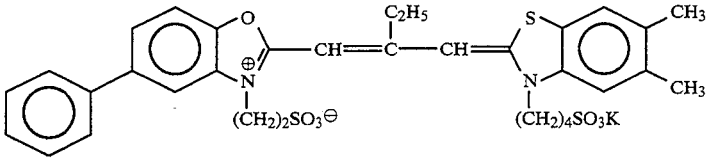

Sensitizing Dye S-5:

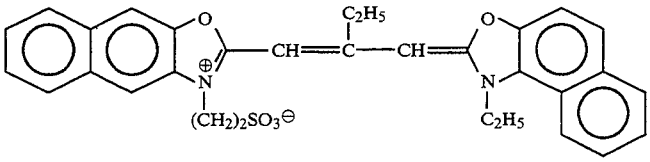

Sensitizing Dye S-6:

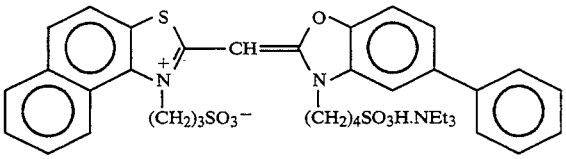

Sensitinzing Dye S-7:

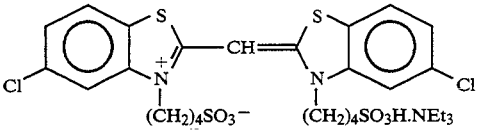

The various properties of the silver halide emulsions thus prepared are summarized in Table 3 below.

TABLE 3

Prepared Emulsions

| Emulsion No. | Grain Size | Mean Aspect Ratio |
|---|---|---|
| Emulsion-A | Tabular grains having thickness of 0.22 μm and diameter of 1.76 μm | 8 |
| Emulsion-B | Tabular grains having thickness of 0.30 μm and diameter of 1.50 μm | 5 |
| Emulsion-C | Tabular grains having thickness of 0.42 μm and diameter of 1.26 μm | 3 |
| Emulsion-D | Tabular grains having thickness of 0.55 μm and diameter of 1.10 μm | 2 |
| Emulsion-E | Cubic grains having diameter of 0.80 μm | 1 |
| Emulsion-F | Octahedral grains having diameter of 0.80 μm | 1 |

TABLE 3-continued

Prepared Emulsions

| Emulsion No. | Grain Size | Mean Aspect Ratio |
|---|---|---|
| Emulsion-G | Spherical grains having diameter of 0.80 μm | 1 |

The preparation method of a gelatin dispersion of the dye-providing material is explained below.

18 g of yellow dye providing material (1)* was dissolved in 12 g of high-boiling organic solvent (1)* and 51 ml of ethyl acetate by heating to about 60° C. to form a uniform solution. After mixing the solution with 100 g of an aqueous solution of 10% limed gelatin, 60 ml of water, and 1.5 g of sodium dodecylbenzenesulfonate with stirring, the mixture was dispersed by a homogenizer at 10,000 r.p.m. for 10 minutes. The dispersion is called the dispersion of yellow dye-providing material.

By following the same procedure as set forth above, the dispersions of a magenta dye-providing material and a cyan dye-providing material were prepared using magenta dye-providing material (2)* and cyan dye-providing material (3)*.

The method of preparing the gelatin dispersion of the electron donor is explained below.

20.6 g of electron donor (1)* was dissolved in 13.1 g of high-boiling organic solvent (1)* and 120 ml of ethyl acetate by heating to about 60° C. to form a uniform solution. After mixing the solution with 100 g of an aqueous solution of 10% limed gelatin, 60 ml of water, and 1.5 g of sodium dodecylbenzenesulfonate with stirring, the mixture was dispersed by a homogenizer at 10,000 r.p.m. for 10 minutes. The dispersion is called the dispersion of electron donor.

The method of preparing the gelatin dispersion of the non-diffusible reducing agent for the interlayer is explained below.

23.5 g of non-diffusible reducing agent (1)* was dissolved in 8.5 g of high-boiling organic solvent (1)* and 120 ml of ethyl acetate at about 60° C. to form a uniform solution. After mixing the solution with 100 g of an aqueous solution of 10% limed gelatin, 15 ml of an aqueous solution of 5% surface active agent (2)*, and 0.2 g of dodecylbenzenesulfonic acid with stirring, the mixture was dispersed by a homogenizer at 10,000 r.p.m. for 10 minutes. The dispersion is called the dispersion of non-diffusible reducing agent for the interlayer.

By using the above-described dispersions, comparison light-sensitive element (101) having the construction (layer structure) shown below was prepared.

| | (g/m²) |
|---|---|
| Support: | |
| Polyethylene terephthalate film of 100 μm in thickness. | |
| Back Layer | |
| Carbon black | 4.0 |
| Gelatin | 2.0 |
| Layer 1: Cyan Coloring Material Layer | |
| Cyan Dye-Providing Material (3)* | 0.38 |
| Electron Donor (1)* | 0.13 |
| Gelatin | 0.38 |
| High-Boiling Organic Solvent (1)* | 0.27 |
| Water-Soluble Polymer (1)* | $4.3 \times 10^{-3}$ |
| Layer 2: Red Light-Sensitive Layer | |
| Emulsion E (containing sensitizing dyes S-1 and S-2) | 0.23 as Ag |
| Gelatin | 0.34 |
| Surface Active Agent (1)* | $6.7 \times 10^{-3}$ |
| Water-Soluble Polymer (1)* | $1.4 \times 10^{-2}$ |
| Layer 3: Interlayer | |
| Non-Diffusible Reducing Agent (1)* | 0.45 |
| High-Boiling Organic Solvent (1)* | 0.16 |
| Gelatin | 0.68 |
| Surface Active Agent (2)* | $6.5 \times 10^{-2}$ |
| Water-Soluble Polymer (1)* | $1.9 \times 10^{-2}$ |
| Layer 4: Magenta Coloring Material Layer | |
| Magenta Dye-Providing Material (2)* | 0.33 |
| Electron Donor (1)* | 0.13 |

-continued

| | (g/m²) |
|---|---|
| Gelatin | 0.38 |
| High-Boiling Organic Solvent (1)* | 0.27 |
| Water-Soluble Polymer (1)* | $4.3 \times 10^{-3}$ |
| Layer 5: Green Light-Sensitive Layer | |
| Emulsion E (containing sensitizing dyes S-3, S-4, and S-5) | 0.23 as Ag |
| Gelatin | 0.34 |
| Surface Active Agent (1)* | $6.7 \times 10^{-2}$ |
| Water-Soluble Polymer (1)* | $1.4 \times 10^{-2}$ |
| Layer 6: Interlayer | |
| Non-Diffusible Reducing Agent (1)* | 0.45 |
| High-Boiling Organic Solvent (1)* | 0.16 |
| Gelatin | 0.68 |
| Surface Active Agent (2)* | $6.5 \times 10^{-2}$ |
| Water-Soluble Polymer (1)* | $1.9 \times 10^{-2}$ |
| Layer 7: Yellow Color Forming Material Layer | |
| Yellow Dye-Providing Material (1)* | 0.37 |
| Electron Donor (1)* | 0.20 |
| Gelatin | 0.53 |
| High-Boiling Organic Solvent (1)* | 0.37 |
| Water-Soluble Polymer (1)* | $6.5 \times 10^{-3}$ |
| Layer 8: Blue Light-Sensitive Layer | |
| Emulsion E (containing sensitizing dyes S-6 and S-7) | 0.23 as Ag |
| Gelatin | 0.34 |
| Surface Active Agent (1)* | $6.7 \times 10^{-3}$ |
| Water-Soluble Polymer (1)* | $1.4 \times 10^{-2}$ |
| Layer 9: Ultraviolet Absorption Layer | |
| Gelatin | 0.47 |
| Ultraviolet Absorbent (1)* | 0.14 |
| Ultraviolet Absorbent (2)* | 0.13 |
| Surface Active Agent (1)* | $1.3 \times 10^{-3}$ |
| Water-Soluble Polymer (1)* | $1.4 \times 10^{-4}$ |
| Layer 10: Protective Layer | |
| Gelatin | 0.17 |
| Matting Agent (1)* | 0.09 |
| Hardening Agent (1)* | $1.9 \times 10$ |
| Surface Active Agent (1)*: | $4.5 \times 10^{-4}$ |
| Surface Active Agent (2)* | $5.0 \times 10^{-5}$ |
| Water-Soluble Polymer (1)* | $3.6 \times 10^{-4}$ |

Then, by changing the emulsions of Layer 2, Layer 5, and Layer 8 to emulsions A to G shown in Table 4 (each emulsion was spectrally sensitized with sensitizing dyes S-1 and S-2 in the case of Layer 2, with sensitizing dyes S-3, S-4, and S-5 in the case of Layer 5, and with sensitizing dyes S-6 and S-7 in the case of Layer 8), Samples 102 to 109 were prepared.

TABLE 4

| | Emulsions Used in Layers in Samples | | |
|---|---|---|---|
| Sample No. | Layer 2 | Layer 5 | Layer 8 |
| 101 | Emulsion-E | Emulsion-E | Emulsion-E |
| 102 | Emulsion-B | Emulsion-B | Emulsion-B |
| 103 | Emulsion-B | Emulsion-A | Emulsion-B |
| 104 | Emulsion-B | Emulsion-C | Emulsion-B |
| 105 | Emulsion-B | Emulsion-D | Emulsion-B |
| 106 | Emulsion-F | Emulsion-F | Emulsion-F |
| 107 | Emulsion-G | Emulsion-G | Emulsion-G |
| 108 | Emulsion-A | Emulsion-A | Emulsion-A |
| 109 | Emulsion-D | Emulsion-D | Emulsion-D |

Sample Nos. 101, 106 and 107 are comparison samples, and the other samples are samples of this invention.

The compounds used for preparing the foregoing samples are shown below.

Matting Agent (1)*: Polymethyl methacrylate sphere latex (mean particle size 4 μm)

Ultraviolet Absorbent (1)*:

-continued
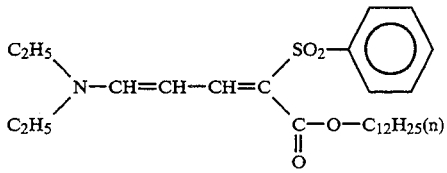
Ultraviolet Absorbent (2)*:
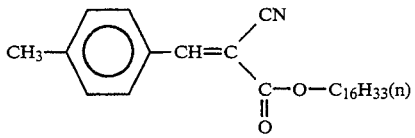
Water-Soluble Polymer (1)*:
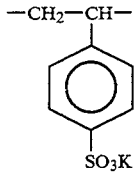
Surface Active Agent (1)*: Aerosol OT
Surface Active Agent (2)*:
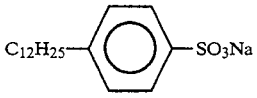
High-Boiling Organic Solvent (1)*:
Tricyclohexyl Phosphate
Hardening Agent (1)*:
1,2-Bis(vinylsulfonylacetamido)ethane
Non-Diffusible Reducing Agent (1)*:
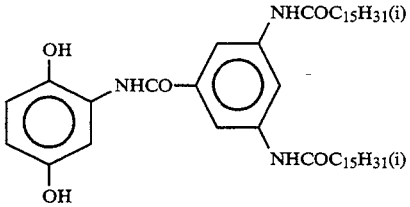
Electron Donor (1)*:
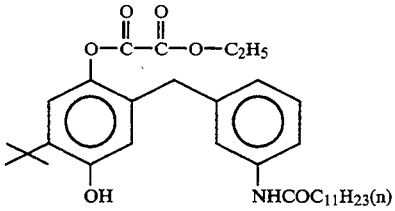
Yellow Dye-Providing Material (1)*:

-continued

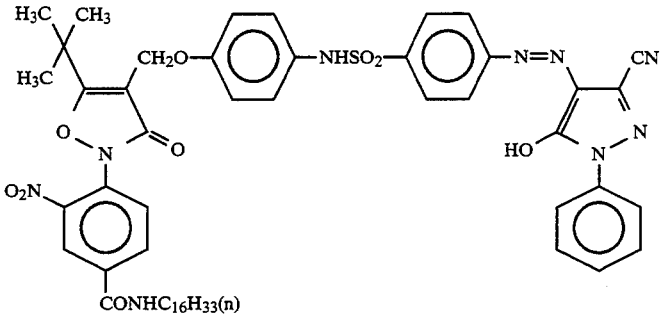

Magenta Dye-Providing Material (2)*:

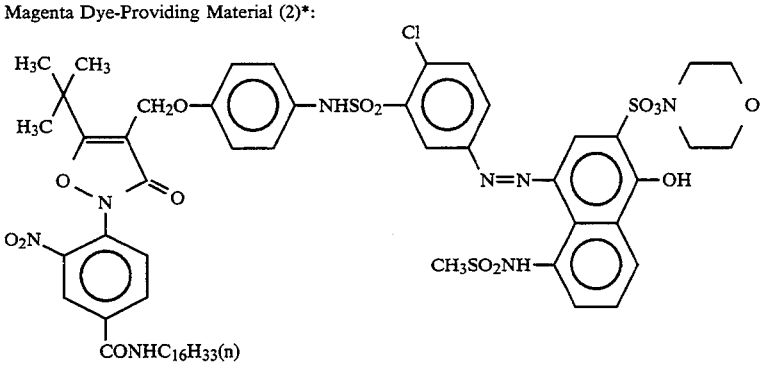

Cyan Dye-Providing Material (3)*:

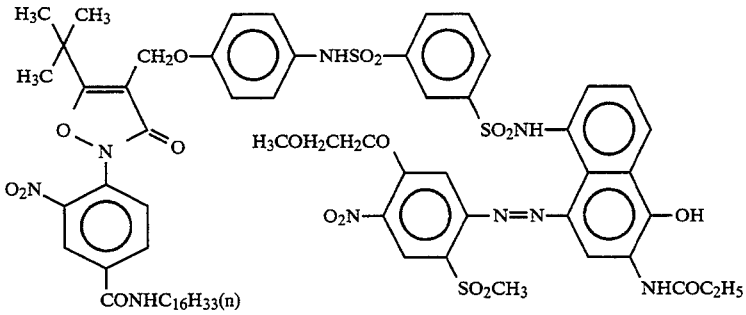

The image-receiving element was prepared as follows.

Paper Support:

Polyethylene was laminated at a thickness of 30 μm on both surfaces of a paper of 150 μm in thickness. The polyethylene layer at the image-receiving layer side contained dispersed therein 10% by weight titanium oxide.

Back Side:

(a) Light-shielding layer containing 4.0 g/m$^2$ of carbon black and 2.0 g/m$^2$ of gelatin.

(b) White layer containing 8.0 g/m$^2$ of titanium oxide and 1.0 g/m$^2$ of gelatin.

(c) Protective layer containing 0.6 g/m$^2$ of gelatin. Layers (a), (b), and (c) were coated in that order and were hardened by the hardening agent shown above.

Image-Receiving Layer Side:

(1) Neutralization layer containing 22 g/m$^2$ of an acrylic acid-butyl acrylate (8.2 mol ratio) copolymer having an average molecular weight of 50,000.

(2) 2nd Timing layer containing 4.5 g/m$^2$ of cellulose acetate having an acetylation degree of 51.3% (the amount of acetic acid released by hydrolysis was 0.513 g per gram of the sample) and a styrene-maleic anhydride (1.1 mol ratio) copolymer having an average molecular weight of about 10,000 at a 95.5 by weight ratio.

(3) Interlayer containing 0.4 g/m$^2$ of poly-2-hydroxyethyl methacrylate.

(4) 1st Timing layer containing a polymer latex obtained by emulsion polymerizing styrene, butyl acrylate, acrylic acid, and N-methylolacrylamide at a 49.7/42.3/4/4 by weight ratio and a polymer latex obtained by emulsion polymerizing methyl methacrylate, acrylic acid, and N-methylolacrylamide at a 93/3/4 by weight ratio blended at a ratio of 6.4 (as solid contents) in an amount of 1.6 g/m$^2$ as total solid components.

(5) Image-receiving layer formed by coating 3.0 g/m$^2$ of the polymer mordant having the following repeating unit and 3.0 g/m$^2$ of gelatin using the following compound as a coating aid.

Polymer mordant unit:

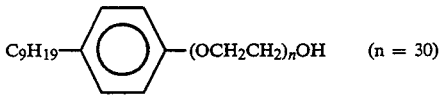

Coating Aid:

-continued

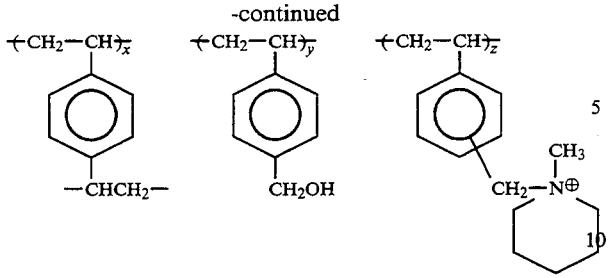

x : y : z = 5:5:90

(6) Protective layer formed by coating 0.6 g/m$^2$ of gelatin.

The layers (1) to (6) were coated in that order and hardened by the hardening agent shown above.

The processing composition is shown below.

0.8 g of a processing liquid having the following composition was packed in a rupturable vessel.

| | |
|---|---|
| 1-p-Tolyl-4-hydroxymethyl-4-methyl-3-pyrazolidone | 10.0 g |
| 1-Phenyl-4-hydroxymethyl-4-methyl-3-pyrazolidone | 4.0 g |
| Potassium sulfite (anhydrous) | 4.0 g |
| Hydroxyethyl cellulose | 40 g |
| Potassium hydroxide | 64 g |
| Benzyl alcohol | 2.0 g |
| Water to make | 1 liter |

After exposing each of foregoing light-sensitive elements (101) to (109) from the emulsion layer side through a gray color separation filter, the light-sensitive element was superposed on the image-receiving layer of the image-receiving element, and the foregoing processing composition was spread between both the elements at a thickness of 60 μm by means of a compressing roller. Processing was carried out at 25° C., and after 1.5 minutes, the light-sensitive element was peeled off from the image-receiving element.

The reflection density of images transferred to each image-receiving element was measured by a color densitometer.

The results are shown in Table 5 below. From the results, it can be seen that images having a low minimum density and an excellent color reproducibility are obtained according to this invention.

TABLE 5

| | Cyan Density | | Magenta Density | | Yellow Density | |
|---|---|---|---|---|---|---|
| Sample No. | Maximum Density | Minimum Density | Maximum Density | Minimum Density | Maximum Density | Minimum Density |
| 101 (Comp. Ex.) | 2.30 | 0.32 | 2.15 | 0.30 | 2.05 | 0.28 |
| 102 (Invention) | 2.33 | 0.26 | 2.17 | 0.19 | 2.10 | 0.21 |
| 103 (Invention) | 2.30 | 0.25 | 2.12 | 0.18 | 2.05 | 0.21 |
| 104 (Invention) | 2.27 | 0.25 | 2.10 | 0.20 | 2.03 | 0.20 |
| 105 (Invention) | 2.30 | 0.26 | 2.20 | 0.22 | 2.05 | 0.20 |
| 106 (Comp. Ex.) | 2.35 | 0.33 | 2.18 | 0.30 | 2.07 | 0.29 |
| 107 (Comp. Ex.) | 2.28 | 0.31 | 2.15 | 0.30 | 2.00 | 0.28 |
| 108 (Invention) | 2.30 | 0.24 | 2.18 | 0.17 | 2.03 | 0.19 |
| 109 (Invention) | 2.35 | 0.27 | 2.13 | 0.21 | 2.00 | 0.22 |

EXAMPLE 2

First, the preparation methods of silver halide emulsions are explained below.

Preparation of Emulsion-H (tabular silver bromide host grains):

While stirring one liter of an aqueous solution of 0.8% by weight gelatin containing 0.08M potassium bromide, 150 ml of an aqueous solution of 2.00M of silver nitrate and 150 ml of an aqueous solution of 2.00M of potassium bromide were added thereto by a double jet method. During the addition, the aqueous solution was kept at 30° C. Thereafter, the temperature thereof was raised to 75° C., and 30 g of gelatin was added thereto.

After finishing the addition in the 1st stage, 90 ml of an aqueous solution of 1.0M of silver nitrate was added to the mixture.

Furthermore, the emulsion was ripened for 30 minutes after the addition of the solution. The grains thus formed (hereinafter referred to as seed crystals) were washed by an ordinary flocculation method, and the pH and pAg of the emulsion were adjusted to 5.0 and 7.5, respectively, at 40° C.

1/10 of the foregoing seed crystals was dissolved in one liter of an aqueous solution of 3% by weight gelatin, and the solution was kept at 75° C. and a pBr of 2.85. Thereafter, 150 g of an aqueous silver nitrate solution was added at an accelerated flow rate (the flow rate at the end was 19 times the flow rate at the beginning) over a period of 60 minutes while keeping the pBr at 2.85.

Thereafter, the emulsion was cooled to 35° C. and washed by an ordinary flocculation method, and after adjusting the pH and pAg thereof to 6.5 and 8.6, respectively, at 40° C., the emulsion was stored in a cold, dark place. Among the tabular silver halide grains, 80% thereof were hexagonal tabular grains, and the coefficient of variation of the grains was 18%. Furthermore, the mean diameter of the circles corresponding to the projected area of the grains was 1.3 μm, and the mean thickness of the grains was 0.25 μm.

Preparation of Emulsion-I (tabular grains having a dislocation on the main surface):

1300 ml of water was added to 500 g of Emulsion-A (containing 90 g as $AgNO_3$), and then 160 ml of an aqueous solution of 0.34M of silver nitrate and 160 ml of an aqueous solution of 0.8M sodium chloride were added to the mixture at a potential of +190 mV (to saturated calomel electrode) over a period of 8 minutes. In this case, many fine silver chloride epitaxies formed on the main surface of the tabular host grains (not at the edge portions of the tabular grains). The temperature of the emulsion was raised to 750° C., physical ripening thereof was carried out for 12 minutes, and after adding thereto 30 ml of an aqueous solution of 2.5M potassium bromide, 160 ml of an aqueous solution of 0.34M silver nitrate and 160 ml of an aqueous solution of 0.34M potassium bromide were added thereto at 75° C. over a period of 8 minutes.

Thereafter, the emulsion was cooled to 35° C. and washed by an ordinary flocculation method. Then, 50 g of bone gelatin was added to the emulsion, and after adjusting the pH and pAg thereof to 6.5 and 8.5, respectively, at 40° C., the emulsion was stored in a cold, dark place.

Preparation of Emulsion-J (tabular grains having no dislocation):

The same procedure which was used in preparing Emulsion-B was followed, except that 160 ml of an aqueous solution of 0.34M of silver nitrate and 160 ml of an aqueous solution of 0.8M of potassium bromide were added at a potential of +190 mV at 40° C. over a period of 8 minutes.

Preparation of Emulsion-K (tabular grains having dislocations at the edge portions only):

1300 ml of water and 30 ml of an aqueous solution of 2.5M of potassium bromide were added to 500 g of Emulsion-A, and then 100 ml of an aqueous solution of 0.09M silver nitrate and 100 ml of 0.09M potassium iodide were added thereto by a double jet method at 40° C. over a period of 10 minutes. The temperature of the emulsion was raised to 75° C., and after physically ripening the emulsion for 12 minutes, 160 ml of an aqueous solution of 0.34M silver nitrate and 160 ml of an aqueous solution of 0.34M potassium bromide were added thereto over a period of 8 minutes. Thereafter, the emulsion was treated as in the preparation of Emulsion-B.

Observation to determine whether dislocations were introduced into tabular grains:

The dislocations in Emulsions-I, J, and K were directly observed using a transmission type electron microscope. As the electron microscope, JEM 2000 FX-II (trade name, manufactured by JEOL Ltd.) was used, and the dislocations were observed at an acceleration voltage of 200 kV and a temperature of −120° C.

It was seen from the transmission photographs that in Emulsion-I, dislocations existed on the whole main surfaces of the grains. On the other hand, in Emulsion-J, dislocations were concentrated only at the edge portions of the tabular grains. Also, in Emulsion-K, no dislocations were observed.

Preparation of Emulsion-L (silver bromide cubic grains):

First, solutions I to III shown in Table 6 below were prepared, and then Emulsion-L was prepared using the solutions.

TABLE 6

| Solution | Composition of Aqueous Solution |
|---|---|
| Solution I | Aqueous solution containing 30 g of inert gelatin and 0.07 g of KBr in one liter of water. |
| Solution II | Aqueous solution containing 170 g of $AgNO_3$ in one liter of water. |
| Solution III | Aqueous solution containing 116.2 g of KBr in one liter of water. |

Solution II and solution III were added to solution I by a double jet method while keeping the pAg at 7.1 in Stage 1 and Stage 2 as shown in Table 7 below. Thereafter, the emulsion formed was cooled to 35° C. and washed by an ordinary flocculation method. Then, 50 g of bone gelatin was added to the emulsion, and after adjusting the pH and pAg thereof to 6.5 and 8.5, respectively, at 40° C., the emulsion was stored in a cold, dark place.

TABLE 7

| Stage 1 | | | Stage 2 | | |
|---|---|---|---|---|---|
| Soln. II (ml) | Soln. III (ml) | Addn. Time | Soln. II (ml) | Soln III (ml) | Addn. Time |
| 118 | 118 | 20 min. | 471 | 471 | 40 min. |

Solution II and solution III were added by a double jet method in stage 1 and stage 2 as shown above in Table 7 while keeping the pAg at 7.1. Thereafter, the emulsion was cooled to 35° C. and washed by an ordinary flocculation method. Then, 50 g of bone gelatin was added thereto, and after adjusting the pH and pAg thereof to 6.5 and 8.5, respectively, at 40° C., the emulsion was stored in a cold, dark place.

Preparation of Emulsions I1, J1, K1, and L1 for Red-Sensitive Layer:

To each of emulsions I to L were added sensitizing dyes S-8 and S-9 shown below, and after 10 minutes therefrom, ammonium thiosulfate was added thereto in an amount of $4\times10^{-3}$ mol per mol of silver. Also, $Na_2SO_3$ and $KAuCl_4$ were added thereto to carry out chemical ripening. At the time, when the emulsion reached the maximum sensitivity, the temperature was lowered to finish the chemical sensitization to provide Emulsions-I1, J1, K1, and L1.

The addition amounts of the sensitizing dyes S-8 and S-9, $Na_2SO_3$, and $KAuCl_4$ were selected such that each emulsion obtained the maximum sensitivity.

Preparation of Emulsions I2, J2, K2, and L2 for Green-Sensitive Layer:

By following the same procedure which was used in preparing emulsions I1, J1, K1, and L1 for the red-sensitive layer, except that sensitizing dye S-10 shown below was used in place of the sensitizing dyes S-8 and S-9, emulsions I2, J2, K2, and L2 for the green-sensitive layer were prepared.

Preparation of Emulsions I3, J3, K3, and L3 for Blue-Sensitive Layer:

By following the same procedure which was used in preparing emulsions I1, J1, K1, and L1 for the red-sensitive layer, except that sensitizing dye S-11 was used in place of the sensitizing dyes S-8 and S-9, emulsions I3, J3, K3, and L3 for the green-sensitive layer were prepared.

Sensitizing Dye S-8:

-continued

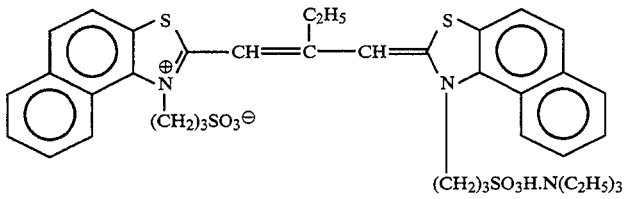

Sensitizing Dye S-9:

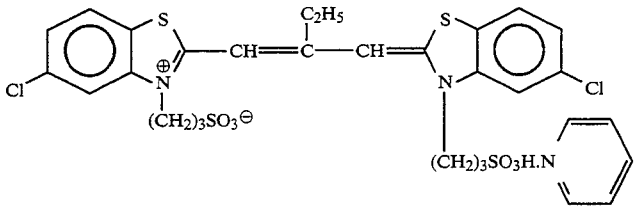

Sensitizing Dye S-10:

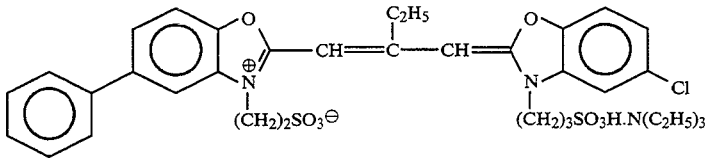

Sensitizing Dye S-11:

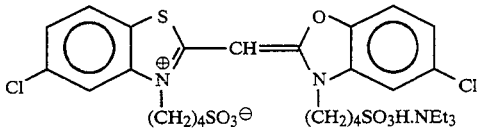

The silver halide emulsions thus prepared are summarized in Table 8 below.

TABLE 8

| Emulsion Nos. | Grain Size |
|---|---|
| Emulsions I1 to I3 | Tabular grains having thickness of 0.30 μm and diameter of 1.50 μm. |
| Emulsions J1 to J3 | Tabular grains having thickness of 0.27 μm and diameter of 1.58 μm |
| Emulsions K1 to K3 | Tabular grains having thickness of 0.29 μm and diameter of 1.53 μm |
| Emulsions L1 to L3 | Cubic grains having thickness of 0.80 μm. |

Then, by following the same procedure as in Example 1, except that the emulsions in Table 8 were used as shown in Table 9 below, light-sensitive elements 201 to 207 were prepared.

TABLE 9

| Sample No. | Layer 2 | Layer 5 | Layer 8 |
|---|---|---|---|
| 201 | Emulsion-L1 | Emulsion-L2 | Emulsion-L3 |
| 202 | Emulsion-L1 | Emulsion-I2 | Emulsion-L3 |
| 203 | Emulsion-L1 | Emulsion-J2 | Emulsion-L3 |
| 204 | Emulsion-L1 | Emulsion-K2 | Emulsion-L3 |
| 205 | Emulsion-I1 | Emulsion-I2 | Emulsion-I3 |
| 206 | Emulsion-J1 | Emulsion-J2 | Emulsion-J3 |
| 207 | Emulsion-K1 | Emulsion-K2 | Emulsion-K3 |

Sample Nos. 201, 203, 204, 206, and 207 are comparison samples, and Sample Nos. 202 and 205 are samples of this invention.

Layer 2: Red light-sensitive layer
Layer 5: Green light-sensitive layer
Layer 8: Blue light-sensitive layer.

Each of the light-sensitive elements 201 to 207 was exposed from the emulsion layer side through a gray color separation filter, superposed on the image-receiving layer of the image-receiving element used in Example 1, and the processing composition used in Example 1 was spread between both the elements at a thickness of 60 μm by means of a press roller. Pressing was carried out at 25° C., and after 1.5 minutes, the light-sensitive element was peeled off from the image-receiving element.

The reflection density of images transferred to each image-receiving element was measured by a color densitometer, and the results are shown in Table 10 below.

TABLE 10

| Sample | Measurement Results | | | | | | | | |
|---|---|---|---|---|---|---|---|---|---|
| | Maximum Density | | | Minimum Density | | | Relative Sensitivity* | | |
| No. | Y | M | Cy | Y | M | Cy | Y | M | Cy |
| 201 | 2.05 | 2.15 | 2.30 | 0.28 | 0.30 | 0.32 | 100 | 100 | 100 |
| 202 | 2.04 | 2.18 | 2.32 | 0.28 | 0.19 | 0.33 | 105 | 135 | 104 |
| 203 | 2.03 | 2.18 | 2.28 | 0.27 | 0.20 | 0.32 | 92 | 55 | 93 |
| 204 | 2.06 | 2.16 | 2.25 | 0.28 | 0.31 | 0.31 | 106 | 125 | 104 |
| 205 | 2.07 | 2.17 | 2.30 | 0.21 | 0.19 | 0.26 | 110 | 138 | 115 |
| 206 | 2.09 | 2.19 | 2.32 | 0.20 | 0.20 | 0.26 | 80 | 55 | 65 |
| 207 | 2.10 | 2.16 | 2.30 | 0.30 | 0.31 | 0.33 | 108 | 130 | 135 |

Relative sensitivity*: Relative value when the sensitivity of each layer of the light-sensitive element 201 at a density of 1.0 was defined as 100. Sample Nos. 201, 202, 204, 206, and 207 are comparison samples, and Sample Nos. 202 and 205 are samples of this invention.

From the results shown above, it can be seen that according to this invention, excellent images having a high sensitivity and a low minimum density are obtained.

While the invention has been described in detail and with reference to specific embodiments thereof, it will be apparent to one skilled in the art that various changes and modifications can be made therein without departing from the spirit and scope thereof.

What is claimed is:

1. A color diffusion transfer light-sensitive material comprising a support having thereon at least one light-sensitive emulsion layer associated with a dye image-forming material and an electron donor, wherein said dye image-forming material comprises at least one reducible dye-providing compound represented by formula (I) which releases a diffusible dye upon being reduced and tabular silver halide grains having a mean grain diameter of at least about 0.3 μm, a mean grain thickness of less than about 0.5 μm, and a mean aspect ratio of at least about 2 account for at least about 50% of the total projected area of the silver halide grains contained in at least one layer of the at least one light-sensitive emulsion layer; said tabular silver halide grains each comprising (A) a host grain having a surface and (B) a shell having an inner surface and an outer surface;

$$\text{PWR - (Time)}_t\text{ Dye} \qquad \text{(I)}$$

wherein PWR represents a group capable of releasing -(Time)$_t$-Dye upon being reduced; Time represents a group capable of releasing Dye through a subsequent reaction after being released as -(Time)$_t$-Dye from PWR; t represents 0 or 1; and Dye represents a dye or a dye precursor; and wherein the tabular silver halide grains are tabular silver chlorobromide grains having main parallel planes on opposite sides of the grains, wherein the main parallel planes are composed of (111) crystal planes and at least 30% of the tabular grains have dislocations only in the main parallel planes, wherein the dislocations exist in the main parallel planes between the surface of the host grain and the outer surface of the shell.

2. The color diffusion transfer light-sensitive material as in claim 1, wherein at least about 50% of the total projected area of the silver halide grains contained in at least one layer of the at least one light-sensitive emulsion layer are silver halide grains having a mean grain diameter of at least about 0.3 μm, a mean grain thickness of less than about 0.5 μm, and a mean aspect ratio of at least 5.

3. The color diffusion transfer light-sensitive material as in claim 1, wherein the mean aspect ratio is from 3 to 12.

4. The color diffusion transfer light-sensitive material as in claim 3, wherein the mean aspect ratio is from 5 to 10.

5. The color diffusion transfer light-sensitive material as in claim 1, wherein the mean grain diameter is from 0.3 μm to 10 μm.

6. The color diffusion transfer light-sensitive material as in claim 5, wherein the mean grain diameter is from 0.5 μm to 5.0 μm.

7. The color diffusion transfer light-sensitive material as in claim 6, wherein the mean grain diameter is from 0.5 μm to 2.0 μm.

8. The color diffusion transfer light-sensitive material as in claim 1, wherein the mean grain thickness is from 0.05 μm to 0.4 μm.

9. The color diffusion transfer light-sensitive material as in claim 8, wherein the mean grain thickness is from 0.08 μm to 0.3 μm.

10. The color diffusion transfer light-sensitive material as in claim 1, wherein the tabular grains account for at least 70% of the total projected area of the silver halide grains.

11. The color diffusion transfer light-sensitive material as in claim 10, wherein the tabular grains account for at least 90% of the total projected area of the silver halide grains.

12. The color diffusion transfer light-sensitive material as in claim 1, wherein the at least one reducible dye-providing compound is represented by formula (C-II):

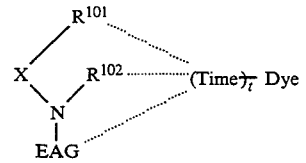

(C-II)

wherein (Time)$_t$ Dye is bonded to at least one of $R^{101}$, $R^{102}$, and EAG; X represents —O—, —S—, —N($R^{103}$)—; EAG represents a group receiving an electron from a reducing material; and $R^{101}$, $R^{102}$, and $R^{103}$ each represents a group other than a hydrogen atom or a simple bond.

13. The color diffusion transfer light-sensitive material as in claim 12, wherein $R^{101}$ and $R^{103}$ are independently selected from the group consisting of an alkyl group, an alkenyl group, an alkynyl group, an aryl group, a heterocyclic group, an acyl group, a sulfonyl group, a carbamoyl group, and a sulfamoyl group each of which can be substituted or unsubstituted.

14. The color diffusion transfer light-sensitive material as in claim 13, wherein $R^{101}$ and $R^{103}$ each have from 1 to 40 carbon atoms.

15. The color diffusion transfer light-sensitive material as in claim 12, wherein $R^{102}$ is a substituted or unsubstituted acyl group or a substituted or unsubstituted sulfonyl group.

16. The color diffusion transfer light-sensitive material as in claim 15, wherein $R^{102}$ has from 1 to 40 carbon atoms.

17. The color diffusion transfer light-sensitive material as in claim 12, wherein $R^{101}$, $R^{102}$ and $R^{103}$ combine with each other to form a 5- to 8-membered ring.

18. The color diffusion transfer light-sensitive material as in claim 12, wherein X is —O—.

19. The color diffusion transfer light-sensitive material as in claim 12, wherein EAG is preferably an aryl group or a heterocyclic group substituted by at least one electron attracting group.

* * * * *